US007445203B2

(12) United States Patent
Kaneko

(10) Patent No.: US 7,445,203 B2
(45) Date of Patent: Nov. 4, 2008

(54) IMAGE FORMING APPARATUS, SHEET PROCESSING APPARATUS, AND SHEET PROCESSING METHOD CAPABLE OF BOOKBINDING

(75) Inventor: Tamaki Kaneko, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 271 days.

(21) Appl. No.: 11/347,245

(22) Filed: Feb. 6, 2006

(65) Prior Publication Data

US 2006/0220293 A1 Oct. 5, 2006

(30) Foreign Application Priority Data

Feb. 4, 2005 (JP) ..... 2005-029175
Dec. 2, 2005 (JP) ..... 2005-349781

(51) Int. Cl.
*B65H 37/04* (2006.01)

(52) U.S. Cl. ..... 270/58.08; 270/58.07; 270/58.12; 270/58.13; 270/58.27; 270/58.28

(58) Field of Classification Search ..... 270/58.07, 270/58.08, 58.12, 58.13, 58.27, 58.28
See application file for complete search history.

(56) References Cited

U.S. PATENT DOCUMENTS 4,913,426 A 4/1990 Kaneko
5,320,336 A * 6/1994 Asami ..... 270/58.08
2004/0251608 A1* 12/2004 Saito et al. ..... 271/220

FOREIGN PATENT DOCUMENTS

JP 02-144370 6/1990
JP 2003-212418 7/2003

* cited by examiner

*Primary Examiner*—Gene O. Crawford
*Assistant Examiner*—Leslie Nicholson, III
(74) *Attorney, Agent, or Firm*—Oblon, Spivak, McClelland, Maier & Neustadt, P.C.

(57) ABSTRACT

A sheet processing apparatus includes a receiver, an aligner, a stapler, a loading table, and a pusher. The receiver is configured to receive sheets. The aligner is configured to align the sheets. The stapler is configured to staple the aligned sheets. The loading table is configured to load the stapled sheets. The pusher is configured to push the stapled sheets from the stapler toward the loading table.

17 Claims, 27 Drawing Sheets

| FIG. 15A |
| --- |
| FIG. 15B |

IMAGE FORMING APPARATUS, SHEET PROCESSING APPARATUS, AND SHEET PROCESSING METHOD CAPABLE OF BOOKBINDING

CROSS-REFERENCE TO RELATED APPLICATIONS

The present application is based on and claims priority to Japanese patent applications No. 2005-029175 filed on Feb. 4, 2005 and No. 2005-349781 filed on Dec. 2, 2005 in the Japan Patent Office, the entire contents of each of which are hereby incorporated herein by reference.

BACKGROUND OF THE INVENTION

1. Field of the Invention

The present invention relates to an image forming apparatus, a sheet processing apparatus, and a sheet processing method, and more particularly to an image forming apparatus, a sheet processing apparatus, and a sheet processing method capable of bookbinding by stapling sheets with a simple, compact structure.

2. Description of the Background Art

A background sheet processing apparatus, such as a finisher, is generally connected with an image forming apparatus, such as a copier, a printer, or a facsimile, and has a bookbinding function. As the image forming apparatus becomes more compact and multifunctional, the sheet processing apparatus is also requested to become more compact and to occupy less space when connected with the image forming apparatus.

One example of a background sheet processing apparatus includes first and second tables for loading sheets unstapled and stapled. The first and second tables are adjacent to each other in a sheet conveyance direction. Sheets are delivered onto the first and second tables by rollers, and then aligned, stapled, and stacked on the first and second tables. Each of the first and second tables has a bookbinding function including stapling and a loading function including stacking. However, it is difficult for the sheet processing apparatus including the two tables to have a compact shape.

In another example of a background sheet processing apparatus, one of the first and second tables is smaller than the first and second tables of the above example. Sheets are delivered onto the first and second tables by rollers, and then aligned, stapled, and stacked on the first and second tables as in the above example. The smaller table requires complex structures for finishing functions such as feeding the sheets forward and backward between the first and second tables, shifting and aligning the sheets, and holding the sheets to staple them. For example, a mechanism for driving the rollers to perform the finishing functions becomes more complex and requires more parts, resulting in an increase of manufacturing cost. Moreover, it is difficult to move a stapler for stapling the sheets, resulting in difficulty in stapling two positions on a central edge on the sheets.

Such background sheet processing apparatuses having the bookbinding function have a relatively large body compared to the image forming apparatus and include conveying and aligning systems for conveying and aligning sheets to be stapled as well as a driving system including many mechanisms and parts for driving the conveying and aligning systems. As a result, the background sheet processing apparatuses, which occupy a substantial space and are costly, are not in widespread use.

SUMMARY OF THE INVENTION

This specification describes a novel sheet processing apparatus. In one aspect of the present invention, the novel sheet processing apparatus includes a receiver, an aligner, a stapler, a loading table, and a pusher. The receiver is configured to receive sheets. The aligner is configured to align the sheets. The stapler is configured to staple the aligned sheets. The loading table is configured to load the stapled sheets. The pusher is configured to push the stapled sheets from the stapler toward the loading table.

This specification further describes a novel image forming apparatus. In one aspect of the present invention, the novel image forming apparatus includes an image forming mechanism and a sheet processing mechanism. The image forming mechanism is configured to form an image on a sheet. The sheet processing mechanism is configured to process sheets. The sheet processing mechanism includes the receiver, the aligner, the stapler, the loading table, and the pusher.

This specification further describes a novel sheet processing method. In one aspect of the present invention, the novel sheet processing method includes receiving sheets, aligning the sheets, stapling the aligned sheets with a stapler, pushing with a pusher the stapled sheets from the stapler toward a loading table, and loading the stapled sheets onto the loading table.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
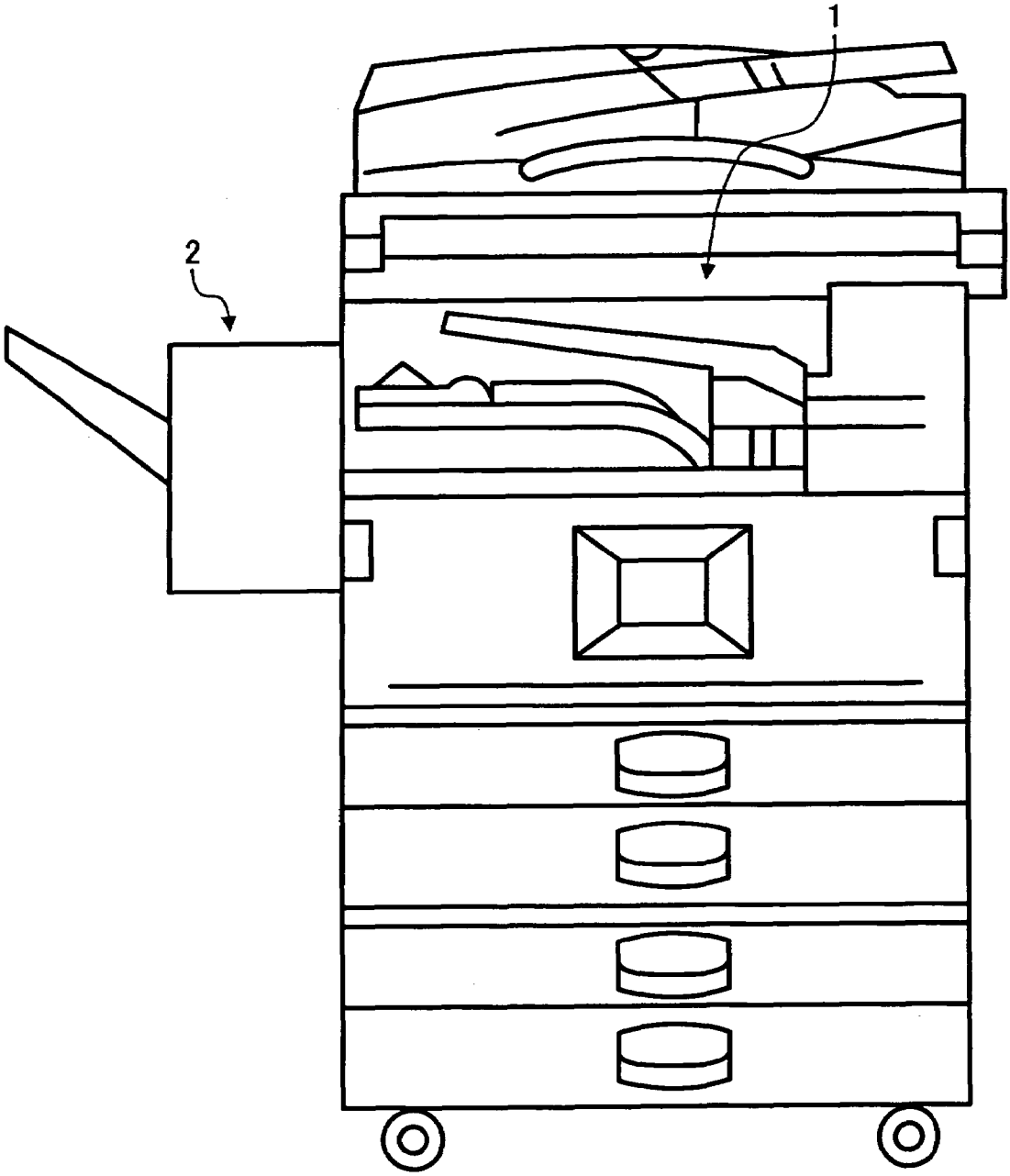
FIG. 1 is an illustration of an image forming apparatus and a sheet processing apparatus connected with each other according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. In the drawings, dotted lines illustrate parts hidden behind particular parts. Alternate long and short dashed lines and chain double-dashed lines illustrate positions of particular parts after they are moved.

Figure 2:
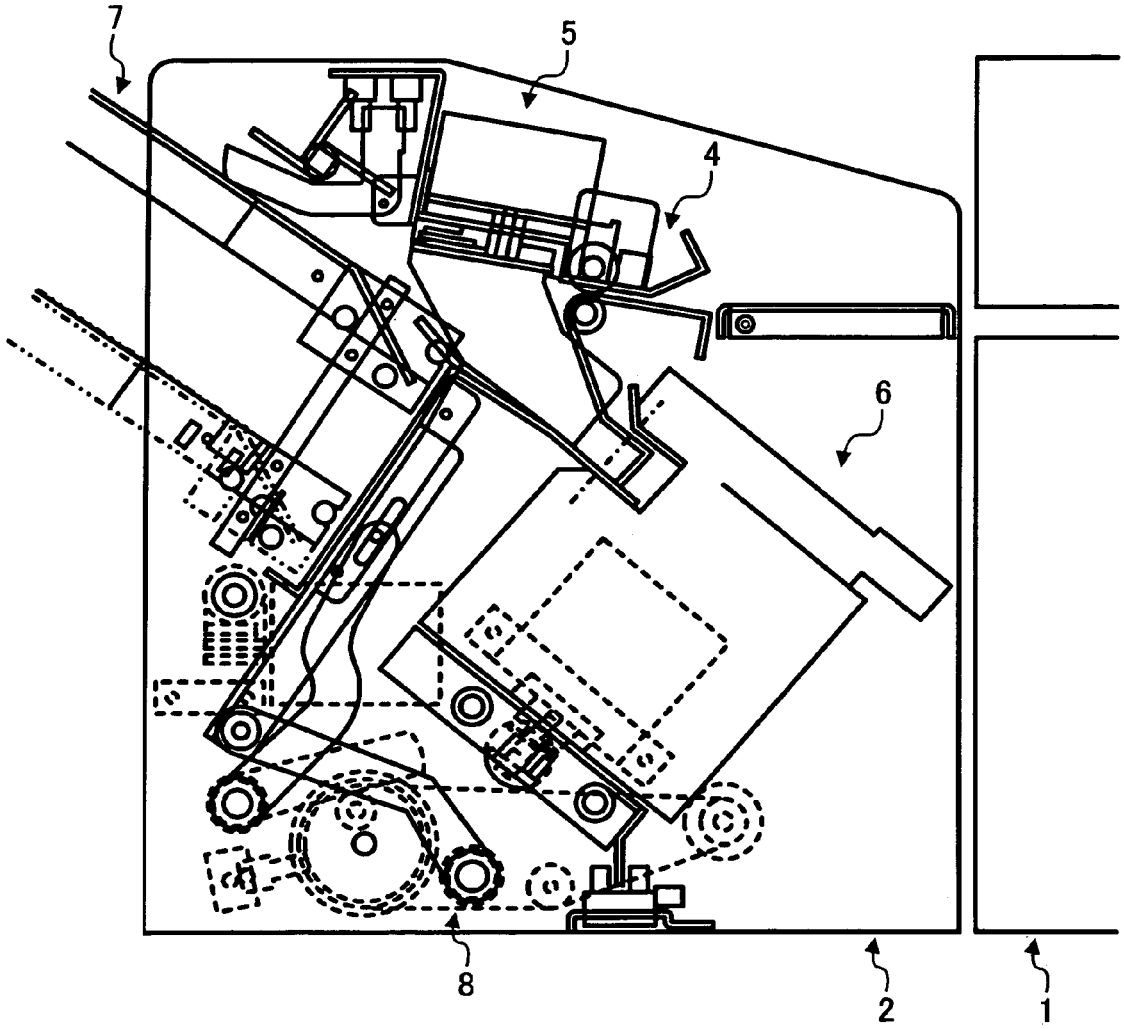
FIG. 2 is a schematic view of the sheet processing apparatus shown in FIG. 1.

Referring now to the drawings, wherein like reference numerals designate identical or corresponding parts throughout the several views, particularly to FIGS. 1 and 2, a sheet processing apparatus connected with an image forming apparatus according to an exemplary embodiment of the present invention is explained.

As illustrated in FIG. 1, a sheet processing apparatus 2 is separately provided from an image forming apparatus 1 and is optionally connected with the image forming apparatus 1. The image forming apparatus 1 includes an image forming mechanism configured to form an image on a sheet and functions as a copier, a printer, a facsimile, or the like. The sheet processing apparatus 2 includes a sheet processing mechanism configured to process sheets and functions as a finisher having a bookbinding function.

As illustrated in FIG. 2, the sheet processing apparatus 2 includes an entrance portion 4, an aligning portion 5, a stapling portion 6, a loading portion 7, and a pushing portion 8.

The entrance portion 4 is configured to receive sheets conveyed from the image forming apparatus 1. The aligning portion 5 is configured to align the sheets so that the sheets are properly aligned to be stapled. The stapling portion 6 is configured to staple the aligned sheets. The pushing portion 8 is configured to deliver the stapled sheets onto the loading portion 7. The loading portion 7 is configured to load the stapled sheets.

Figure 3:
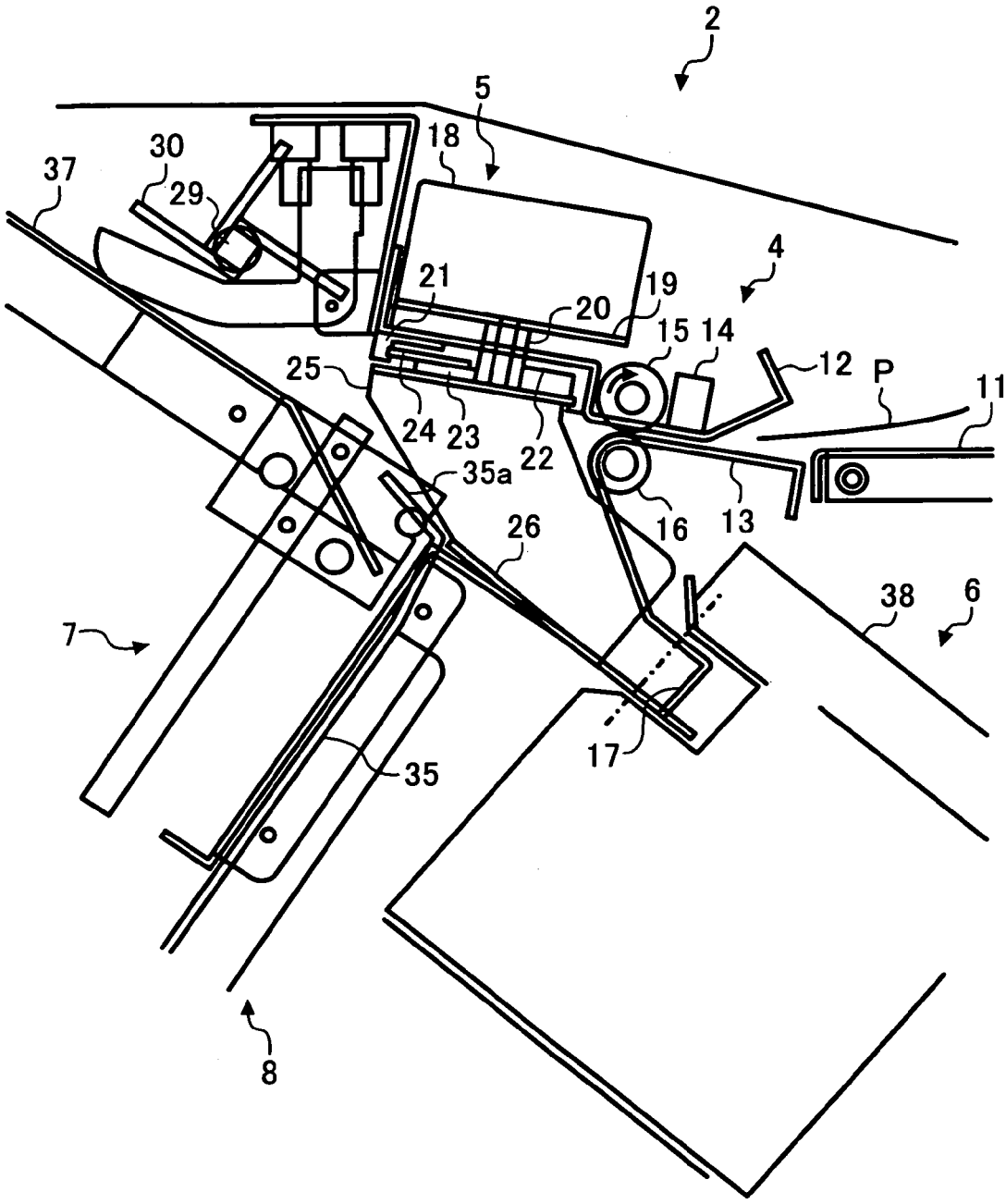
FIG. 3 is a sectional view of the sheet processing apparatus shown in FIG. 2.

As illustrated in FIG. 3, the entrance portion 4 includes an entrance table 11, an upper guide board 12, a lower guide board 13, an upper roller 15, a lower roller 16, and an entrance sensor 14.

The entrance table 11 is configured to guide a sheet P conveyed from the image forming apparatus 1 toward the upper guide board 12 and the lower guide board 13. The upper guide board 12 and the lower guide board 13 are configured to guide the sheet P toward the upper roller 15 and the lower roller 16. The upper roller 15 and the lower roller 16 are driven by a stepping motor (not shown) to rotate to feed the sheet P toward the aligning portion 5. The entrance sensor 14 is disposed in front of the upper roller 15 and the lower roller 16 in a sheet conveyance direction and is configured to detect a tail end of the conveyed sheet P to control a rotating speed of the upper roller 15 and the lower roller 16.

The aligning portion 5 includes a backing shaft 29, a backing vane 30, a bottom aligning board 26, a head aligning board 17, and side aligning boards 25.

The backing shaft 29 is configured to rotatably support the backing vane 30. The backing vane 30 is configured to send the sheet P fed by the upper roller 15 and the lower roller 16 onto the bottom aligning board 26. The bottom aligning board 26 is configured to receive the sheet P sent by the backing vane 30. The head aligning board 17 is configured to align the sheet P hit thereto. The side aligning boards 25 (e.g., jogger fences) are configured to align the sheet P in a direction perpendicular to the sheet conveyance direction.

The stapling portion 6 includes a stapler 38. The stapler 38 is configured to staple the sheets P aligned in the aligning portion 5.

The pushing portion 8 includes a pushing board 35 including a hook 35*a*. The pushing board 35 is configured to receive the sheets P from the head aligning board 17 and to deliver the sheets P onto the loading table 37. The hook 35*a* is disposed in a top end of the pushing board 35 and is configured to hold the sheets P placed on the loading table 37.

The loading portion 7 includes a loading table 37. The loading table 37 is configured to load the sheets P delivered by the pushing board 35.

A sheet P is conveyed from the image forming apparatus 1 into the entrance portion 4 at substantially the same speed at which the sheet P is conveyed inside the image forming apparatus 1. When a predetermined time period passes after the entrance sensor 14 detects the tail end of the conveyed sheet P, the rotating speed of the upper roller 15 and the lower roller 16 is reduced to a predetermined speed. The tail end of the sheet P is conveyed between the upper roller 15 and the lower roller 16, passes under the aligning portion 5, and is delivered onto the loading table 37 at the reduced speed. The sheet P is delivered onto the loading table 37 at the rotating speed of the upper roller 15 and the lower roller 16 controlled as described above so that the backing vane 30 can effectively and stably feed back the sheet P before the tail end of the sheet P passes the hook 35*a*.

When the sheet P delivered onto the loading table 37 stops, a head of the backing vane 30 does not contact the sheet P. After the tail end of the sheet P passes between the upper roller 15 and the lower roller 16, the backing vane 30 rotates counterclockwise to feed back the sheet P so that the tail end of the sheet P is on the bottom aligning board 26 and hits the head aligning board 17. A following sheet P conveyed from the image forming apparatus 1 is fed back by the backing vane 30, is conveyed over the previous sheet P already placed on the bottom aligning board 26, and hits the head aligning board 17. This is repeated until a specified number of the sheets P hit the head aligning board 17.

Figure 4:
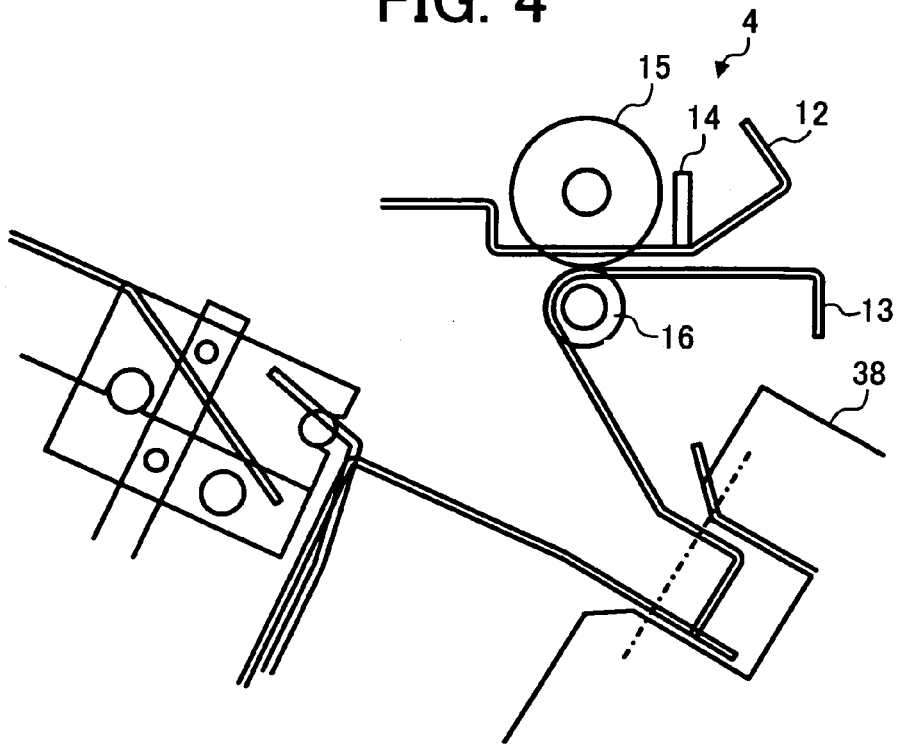
FIG. 4 is a sectional view of an entrance portion of the sheet processing apparatus shown in FIG. 2.

When the rotating speed of the upper roller 15 and the lower roller 16 is reduced, the sheet P may stop while it is conveyed between the upper roller 15 and the lower roller 16. To prevent this problem, the lower roller 16 may have a diameter smaller than that of the upper roller 15 as illustrated in FIG. 4. Thus, the tail end of the sheet P fed by the upper roller 15 and the lower roller 16 can fall onto the bottom aligning board 26 to hit the head aligning board 17 with an improved certainty.

Figure 5:
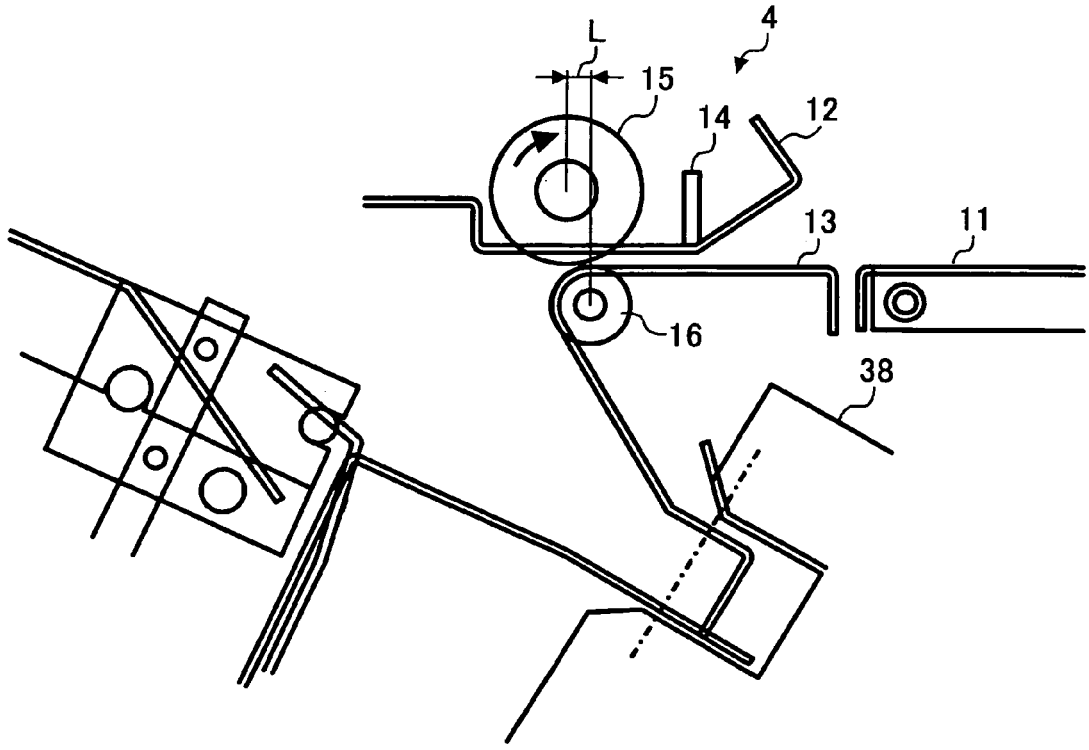
FIG. 5 is a sectional view of another entrance portion of the sheet processing apparatus shown in FIG. 2.

To further prevent the above problem, a rotating axis of the lower roller 16 may be positioned closer to the entrance table 11 than a rotating axis of the upper roller 15 as illustrated in FIG. 5. A length L illustrates a deviation between positions of the rotating axes of the upper roller 15 and the lower roller 16 in the sheet conveyance direction.

The side aligning boards 25 are disposed on both sides in the direction perpendicular to the sheet conveyance direction to align the sheet P in the direction perpendicular to the sheet conveyance direction. According to this non-limiting embodiment, the side aligning boards 25 disposed on the both sides in the direction perpendicular to the sheet conveyance direction independently align the sheet P. However, any one of the side aligning boards 25 may align the sheet P.

Figure 6:
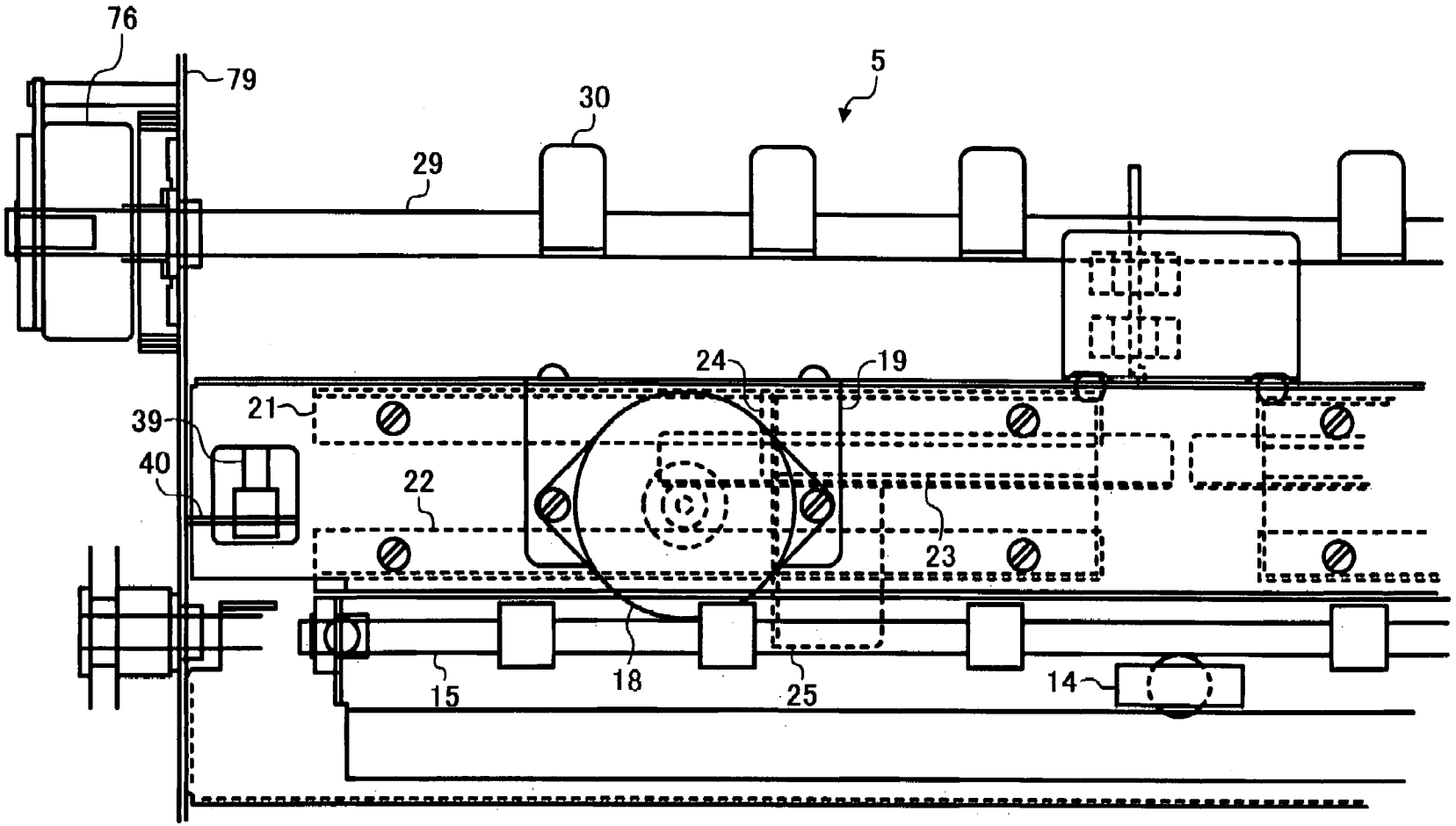
FIG. 6 is a top view of an aligning portion of the sheet processing apparatus shown in FIG. 2.

As illustrated in FIGS. 3 and 6, the aligning portion 5 further includes a right side board 79, a clutch 76, a support 40, an aligning position sensor 39, a moving motor support 19, a side aligning board moving motor 18, a rack 23, a pinion 20, a side aligning board slider 24, a front aligning board guide 21, and a rear aligning board guide 22.

The right side board 79 is configured to support the backing shaft 29 and the clutch 76. The clutch 76 is configured to rotate the backing vane 30. The support 40 is configured to support the aligning position sensor 39. The aligning position sensor 39 is configured to detect the sheet P. The moving motor support 19 is configured to support the side aligning board moving motor 18. The side aligning board moving motor 18 is configured to drive and move the side aligning board 25. The rack 23 and the pinion 20 are engaged with each other to move the side aligning board 25. The side aligning board slider 24 is configured to slide the side aligning board 25. The front aligning board guide 21 and the rear aligning board guide 22 are configured to guide the side aligning board 25.

The backing shaft 29 rotatably supports the backing vane 30. The clutch 76 is driven by a motor (not shown) and rotates the backing vane 30. The backing shaft 29, the backing vane 30, the clutch 76, and the motor are disposed over the loading table 37. The backing shaft 29 and the clutch 76 are attached to the right side board 79.

The side aligning board 25 moves between the front aligning board guide 21 and the rear aligning board guide 22 via the rack 23 and the pinion 20 based on a detection result obtained by the aligning position sensor 39 to align the sheet P. Specifically, the side aligning board 25 moves to a predetermined position to align the sheet P and returns to stop at an original position which is about 5 mm away from a side edge of the sheet P. When a next sheet P hits the head aligning board 17, the side aligning board 25 moves to align the sheet P, and then returns to stop at the original position. This is repeated until a last sheet P is aligned. When the last sheet P hits the head aligning board 17, the side aligning board 25 moves to align the last sheet P and stops in a state that the side aligning board 25 holds the sheets P.

While the side aligning board 25 holds the sheets P, the stapler 38 performs predetermined stapling operations. After stapling, the side aligning board 25 moves to a predetermined position which is about 5 mm away from the side edge of the sheet P and waits for a next operation. FIG. 6 partially illustrates only a left half of the aligning portion 5 in the direction perpendicular to the sheet conveyance direction; however, a right half of the aligning portion 5 is similarly configured. Each of the side aligning boards 25 disposed on both sides in the direction perpendicular to the sheet conveyance direction are independently driven when the side aligning boards 25 are separately moved to shift the sheets P.

The sheets P are aligned in the sheet conveyance direction by being fed back by the backing vane 30 and hitting the head aligning board 17. The sheets P are shifted and collated for either stapling or non-stapling by controlling moving positions of the side aligning boards 25. In this case, how far the side aligning boards 25 move may vary depending on predetermined moving positions.

Figure 7:
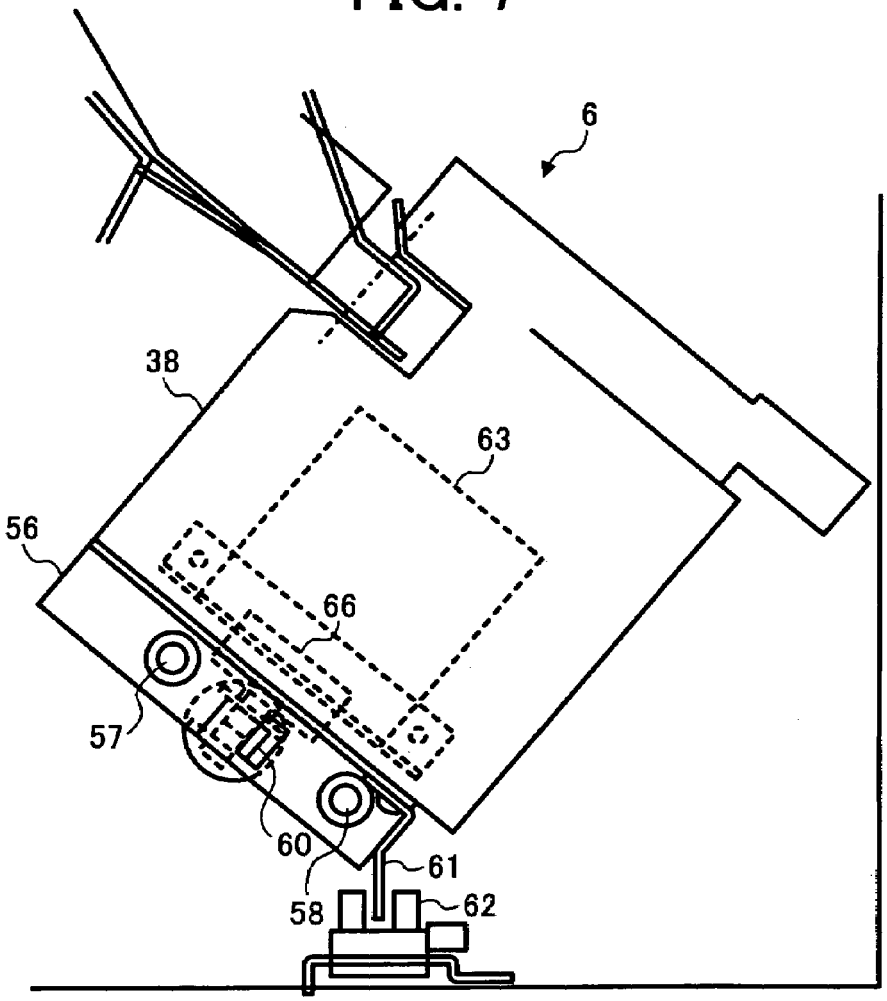
FIG. 7 is a sectional view of a stapling portion of the sheet processing apparatus shown in FIG. 2.
Figure 8:
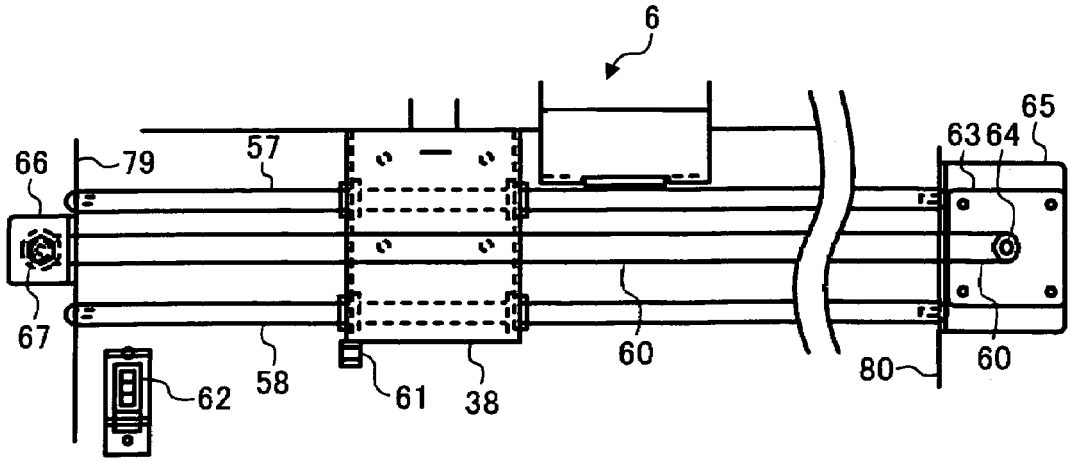
FIG. 8 is a top view of the stapling portion shown in FIG. 7.

As illustrated in FIGS. 7 and 8, the stapling portion 6 further includes a stapler support 56, a stapler moving motor support 65, a left side board 80, a stapler moving motor 63, a pulley support 66, pulleys 64 and 67, a stapler moving belt 60, an upper stapler guide 57, a lower stapler guide 58, a stapler sensor 62, and a detection marker 61.

The stapler support 56 is configured to support the stapler 38. The stapler moving motor support 65 and the left side board 80 are configured to support the stapler moving motor 63. The stapler moving motor 63 is attached to the left side board 80 and is configured to move the stapler 38 in the direction perpendicular to the sheet conveyance direction. The pulley support 66 is attached to the right side board 79 and is configured to support the pulley 67. The pulleys 64 and 67 are configured to have the stapler moving belt 60 looped thereover. The stapler moving belt 60 is configured to have the stapler 38 fixed thereto so as to move with the stapler 38. The upper stapler guide 57 and the lower stapler guide 58 are configured to guide the stapler 38. The stapler sensor 62 is configured to detect the stapler 38. The detection marker 61 is attached to the stapler 38 and is used as a marker detected by the stapler sensor 62 to show a position of the stapler 38.

The stapler 38 moves to an arbitrary predetermined position and stops at the position based on information given in advance by the image forming apparatus 1 to wait for performing stapling operations. The sheets P to be stapled are stacked on the bottom aligning board 26 in a state that the sheets P are aligned in the sheet conveyance direction by the head aligning board 17 and are aligned in the direction perpendicular to the sheet conveyance direction by the side aligning boards 25. The side aligning boards 25 respectively provided on both sides of the sheets P in the direction perpendicular to the sheet conveyance direction hold the sheets P as the stapler 38 moves to staple the sheets P.

Figure 9:
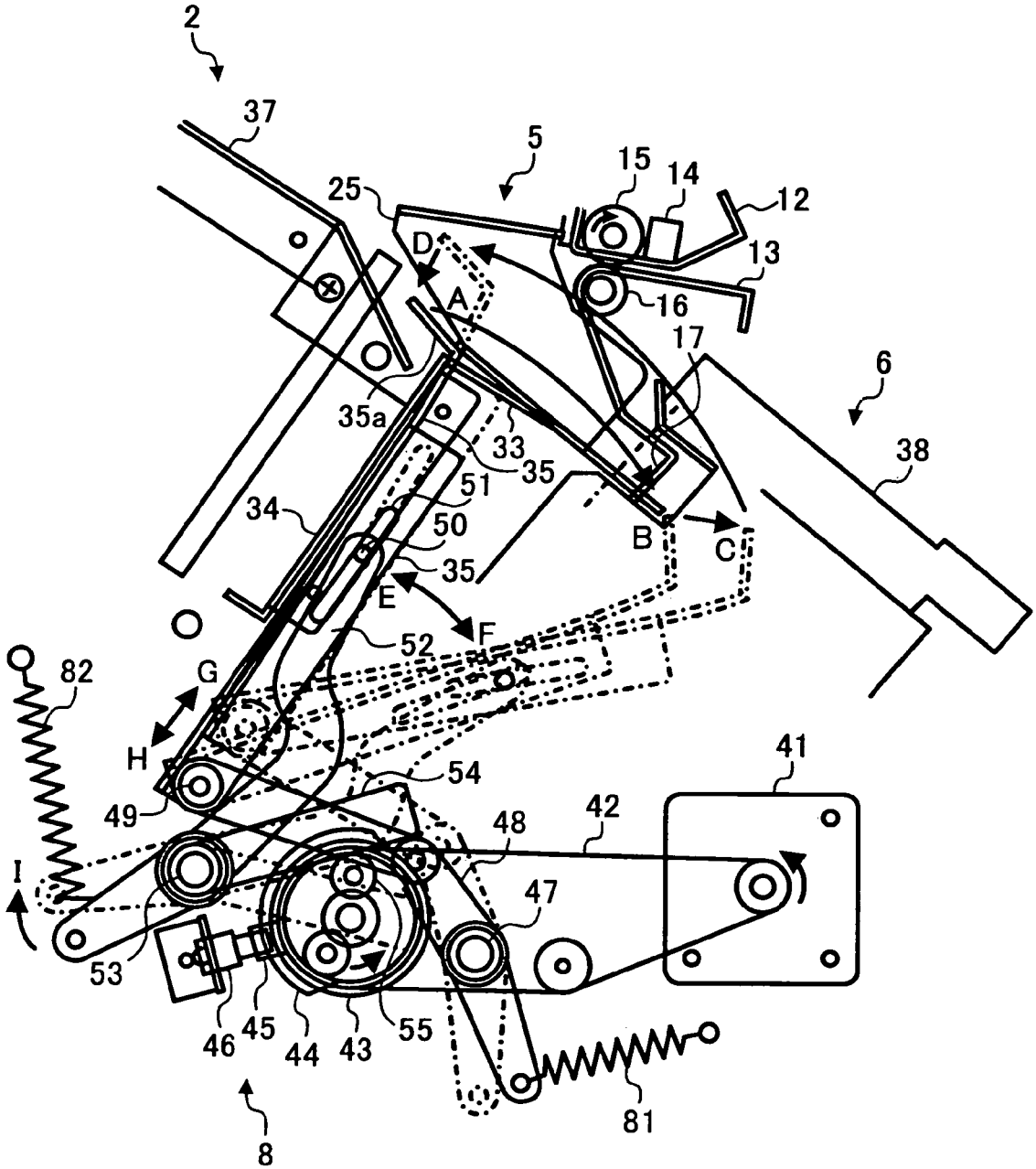
FIG. 9 is a sectional view of a pushing portion of the sheet processing apparatus shown in FIG. 2.

As illustrated in FIG. 9, the pushing portion 8 further includes a front board guide 33, a front board 34, a cam driving motor 41, a cam driving belt 42, a cam driving pulley 43, a cam 44, a cam sensor 46, a shield 45, an upward-downward arm shaft 47, an upward-downward arm 48, a spring 81, a roller 55, a forward-backward arm 54, a spring 82, a pushing board arm 52, an intermediate shaft 50, a groove 51, a pushing board moving shaft 53, and a pushing board support shaft 49.

The front board guide 33 is configured to guide the front board 34. The front board 34 is configured to position the pushing board 35. The cam driving motor 41 is configured to rotate the cam driving belt 42. The cam driving belt 42 is configured to rotate the cam driving pulley 43. The cam driving pulley 43 has the cam 44 attached thereto and is configured to rotate the cam 44. The cam 44 is configured to move the upward-downward arm 48. The cam sensor 46 is configured to detect the cam 44. The shield 45 is configured to be detected by the cam sensor 46. The upward-downward arm shaft 47 is configured to rotatably support the upward-downward arm 48. The upward-downward arm 48 is configured to move the pushing board 35 upward and downward. The spring 81 is configured to apply a force moving the upward-downward arm 48 toward a direction moving the pushing board 35 downward. The roller 55 is attached to the cam driving pulley 43 and is configured to rotate and move to move the forward-backward arm 54. The forward-backward arm 54 is integrated with the pushing board arm 52 to move the pushing board 35 forward and backward. The spring 82 is configured to apply a force moving the pushing board arm 52 toward a direction moving the pushing board 35 downward. The pushing board arm 52 is configured to connect the intermediate shaft 50 with the pushing board moving shaft 53. The intermediate shaft 50 is disposed in a middle portion of the pushing board 35. The groove 51 forms a groove along which the intermediate shaft 50 moves. The pushing board moving shaft 53 is configured to move the pushing board 35 via the pushing board arm 52. The pushing board support shaft 49 is disposed in a bottom end of the pushing board 35 and is configured to rotatably support the pushing board 35.

The hook 35*a* pressingly holds the stapled sheets P placed on the loading table 37. The hook 35*a* is formed in a hook-like shape but may be formed in other shapes. The hook 35*a* is preferably placed on a stapling position on the sheets P so as to press the stapling position on the bulged sheets P placed on the loading table 37.

The pushing board 35 moves from a position A to positions B, C, and D in this order.

The pushing board 35 in the position A is behind the front board 34 positioning the pushing board 35 when the sheets P are placed on the loading table 37. In the position A, the hook 35*a* presses the sheets P placed on the loading table 37 before being aligned and stapled so as to help the sheets P properly go into the aligning portion 5. Then, the pushing board 35 waits for the sheets P to be aligned and stapled. Immediately before the pushing board 35 moves to the position B, the loading table 37 lowers by a predetermined height so that an uppermost surface of the sheets P is positioned under the front board guide 33 to prevent the sheets P from slipping on the loading table 37.

The pushing board 35 moves under the sheets P already stapled or being stapled to move from the position A to the position B. Then, the pushing board 35 moves from the position B to the position C. While moving from the position C to the position D, the pushing board 35 receives the stapled sheets P from the head aligning board 17 and delivers the sheets P onto the loading table 37. The pushing board 35 moves downward to move from the position D to the position A so as to press the sheets P placed on the loading table 37. Thus, a moving cycle of the pushing board 35 is completed.

In the position A, the pushing board 35 continuously receives the sheets P. While the pushing board 35 moves to the positions B, C, and D, operations for bookbinding are simultaneously performed. Namely, when stapling starts, the pushing board 35 simultaneously starts moving from the position A to the position B. The pushing board 35 stops at the position B until stapling finishes. When stapling finishes, the pushing board 35 moves to the positions C and D to deliver the stapled sheets P onto the loading table 37.

Since the pushing board 35 moves as described above, an increased friction between a surface of the pushing board 35 and the sheets P may damage or scratch the sheets P, resulting in problems in aligning, stapling, and conveying the sheets P. Decreasing the friction between the surface of the pushing board 35 and the sheets P can solve those problems. Therefore, according to this non-limiting embodiment, a portion of the pushing board 35 contacting the sheets P includes a low-friction material. However, a whole portion of the pushing board 35 may include the low-friction material. In this case, the whole portion of the pushing board 35 preferably includes a resin (e.g., a high polymer). Examples of the resin include POM (polyacetal resin), ABS (acrylonitrile-butadiene-styrene resin), and the like. When those resins are used, the portion of the pushing board 35 contacting the sheets P can be easily processed to have a low friction. When the pushing board 35 including any one of the resins is not sufficiently strong, the pushing board 35 may include a low-friction material such as metal, and a thin plate including any one of the resins may be attached to the portion of the pushing board 35 contacting the sheets P. Thus, the friction between the surface of the pushing board 35 and the sheets P can be decreased to solve the above problems.

As described above, the pushing board 35 does not just move back and forth on a same route, but moves back and forth on different routes. Specifically, the pushing board 35 moves under the sheets P being stapled to continuously and stably receive the sheets P for continuous stapling.

A speed at which the pushing board 35 moves from the position C to the position D to push the sheets P toward the loading table 37 is set to be slower than a speed at which the pushing board 35 moves from the position A to the position B. Thus, the sheets P can be stably and effectively delivered by using a fast return function described below.

The pushing board 35 starts moving from the position A to the position B after the stapling portion 6 finishes stapling. Thus, the sheets P can be stably delivered.

As described above, immediately before the pushing board 35 starts moving from the position A to the position B, the loading table 37 is controlled to lower until the uppermost surface of the sheets P placed on the loading table 37 is below the front board guide 33. Thus, the sheets P do not slip on the loading table 37 even when the pushing board 35 moves away from the loading table 37.

The pushing board 35 moves upward and downward and moves forward and backward by using simple cam and fast return mechanisms described below. According to the cam and fast return mechanisms, the pushing board 35 is positioned to hold sheets P placed on the loading table 37 while the entrance portion 4 receives another sheet P from the image forming apparatus 1. When stapling finishes, the pushing board 35 starts moving to push stapled sheets P toward the loading table 37, and returns to an original position where the pushing board 35 holds the sheets P placed on the loading table 37. Before the pushing board 35 starts moving, the loading table 37 lowers until the uppermost surface of the sheets P placed on the loading table 37 is below the front board guide 33. After the stapled sheets P are delivered onto the loading table 37, a height of the loading table 37 is adjusted.

The upward-downward arm 48 moves from a position H to a position G to move the pushing board 35 upward from the position B to the position C. The upward-downward arm 48 moves from the position G to the position H to move the pushing board 35 downward from the position D to the position A. The spring 81 continuously applies a force pushing the upward-downward arm 48 toward the position H.

The spring 82 continuously applies a force pushing the forward-backward arm 54 in a direction I. The roller 55 attached to the cam driving pulley 43 rotates and moves to move the forward-backward arm 54 and the pushing board arm 52 integrated with the forward-backward arm 54. The pushing board arm 52 moves from a position E to a position F to move the pushing board 35 from the position A to the position B, and moves from the position F to the position E to move the pushing board 35 from the position C to the position D.

Figure 10:
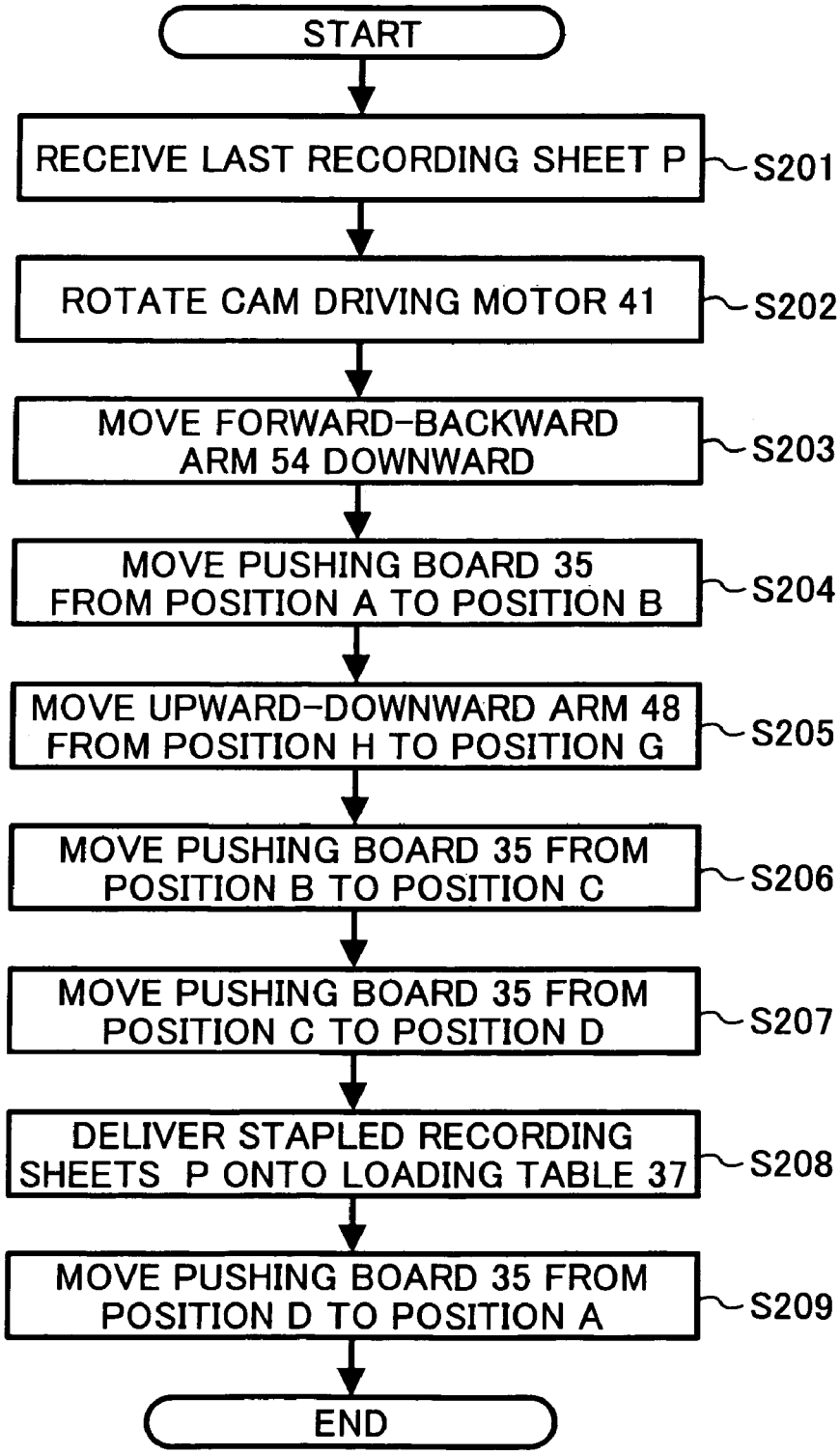
FIG. 10 is a flowchart illustrating operations of cam and fast return mechanisms of the pushing portion shown in FIG. 9.

FIG. 10 illustrates a flowchart of detailed operations of the cam and fast return mechanisms.

In a step S201, the head aligning board 17 receives a last sheet P sent from the image forming apparatus 1. In a step S202, the cam driving motor 41 starts rotating to rotate the cam driving pulley 43 via the cam driving belt 42 so that the cam 44 attached to the cam driving pulley 43 moves the upward-downward arm 48. In a step S203, the roller 55 rotates and moves to move the forward-backward arm 54 downward. In a step S204, the pushing board arm 52 moves from the position E to the position F and the pushing board 35 moves from the position A to the position B at a high speed. In a step S205, the cam 44 attached to the cam driving pulley 43 moves the upward-downward arm 48 from the position H to the position G. In a step S206, the bottom end of the pushing board 35 moves from the position H to the position G and the top end of the pushing board 35 moves from the position B to the position C. In a step S207, the roller 55 moves the forward-backward arm 54 upward, the pushing board arm 52 moves from the position F to the position E, and thereby the pushing board 35 moves from the position C to the position D at a low speed. As described above, the fast return mechanism moves the pushing board 35 from the position A to the position B at a relatively high speed and from the position C to the position D at a relatively low speed. The cam sensor 46 is provided to control above-described operations, for example, to control the cam driving motor 41.

In a step S208, while the top end of the pushing board 35 moves from the position C to the position D, the pushing board 35 receives the stapled sheets P from the head aligning board 17 and delivers the stapled sheets P onto the loading table 37. In a step S209, the upward-downward arm 48 moves downward, and accordingly the bottom end of the pushing board 35 moves from the position G to the position H and the top end of the pushing board 35 moves from the position D to the position A. The hook 35*a* disposed in the top end of the pushing board 35 holds the stapled sheets P placed on the loading table 37. Then, a next bookbinding operation starts.

Figure 11:
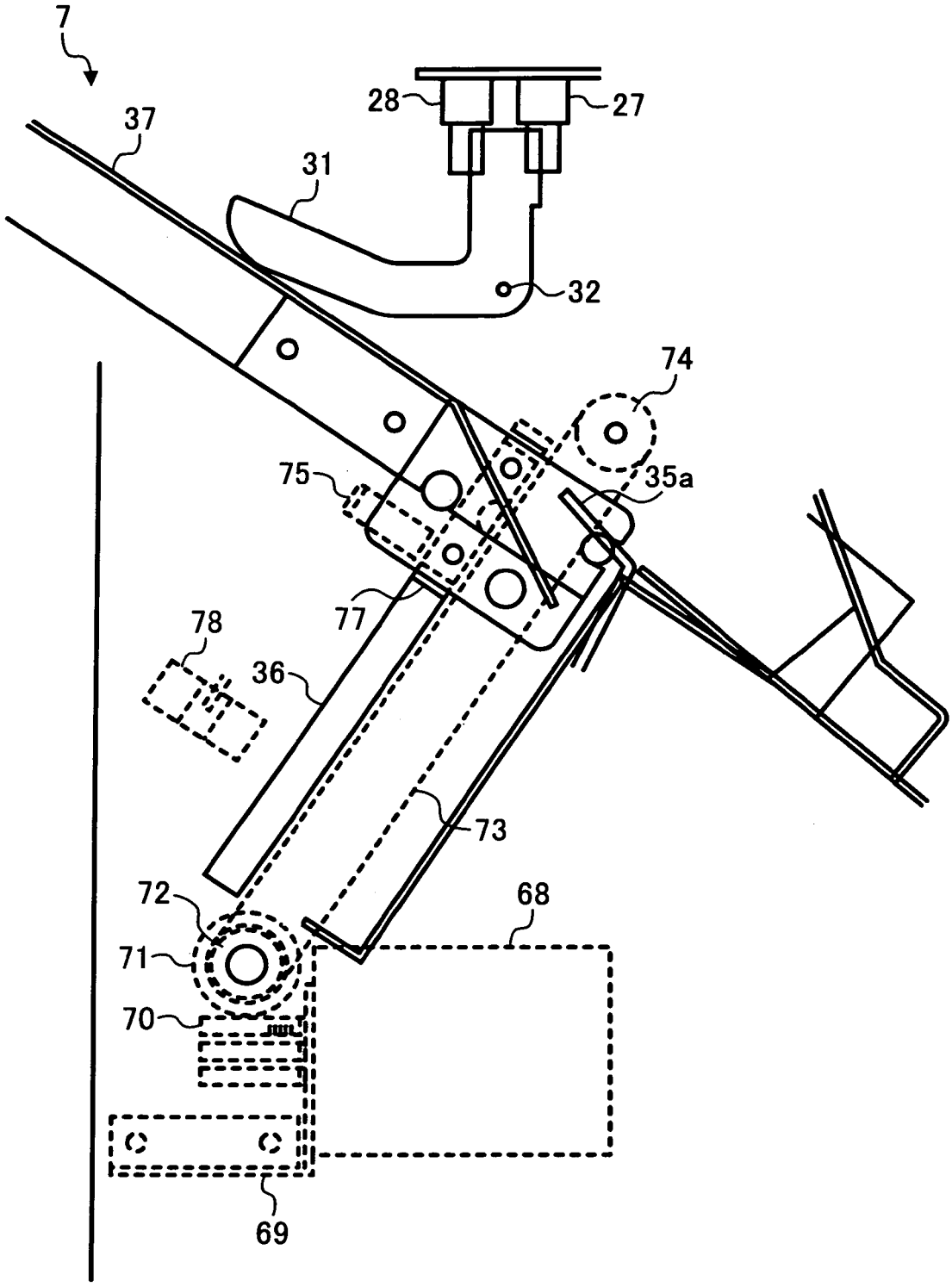
FIG. 11 is a sectional view of a loading portion of the sheet processing apparatus shown in FIG. 2.

As more stapled sheets P are loaded onto the loading table 37, the loading table 37 lowers to receive next stapled sheets P. As illustrated in FIG. 11, the loading portion 7 further includes a filler shaft 32, a sheet sensor 31, a lowering sensor 27, a lifting sensor 28, a lowest position sensor 78, a lifting-lowering motor support 69, a lifting-lowering motor 68, a worm 71, a worm gear 70, a worm pulley 72, an upper pulley 74, a lifting-lowering belt 73, a loading table slider 77, a loading table guide 36, and a lowest position shield 75.

The filler shaft 32 is configured to rotatably support the sheet sensor 31. The sheet sensor 31 is configured to detect a sheet P sent onto the loading table 37. The lowering sensor 27 and the lifting sensor 28 are configured to detect the sheet P contacting the sheet sensor 31. The lowest position sensor 78 is configured to detect the loading table 37 when the loading table 37 reaches its lowest position. The lifting-lowering motor support 69 is configured to support the lifting-lowering motor 68. The lifting-lowering motor 68 is configured to rotate to lift and lower the loading table 37. The worm 71 and the worm gear 70 are configured to rotate to transmit rotations of the lifting-lowering motor 68 to the lifting-lowering belt 73. The worm pulley 72 and the upper pulley 74 are configured to have the lifting-lowering belt 73 looped thereover. The lifting-lowering belt 73 is configured to transmit rotations of the worm 71 to the loading table 37. The loading table slider 77 is disposed on a base of the loading table 37 and is configured to lift and lower along the loading table guide 36. The loading table guide 36 is configured to guide the loading table slider 77. The lowest position shield 75 protrudes from the loading table slider 77 so that the loading table 37 stops lowering when the lowest position sensor 78 detects the lowest position shield 75.

When the lowering sensor 27 or the lifting sensor 28 detects the sheet P contacting the sheet sensor 31, the lifting-lowering motor 68 rotates to lift or lower the loading table 37 to a proper position. Specifically, when the pushing board 35 delivers the stapled sheets P onto the loading table 37, the sheet sensor 31 sends information about a height of the stapled sheets P placed on the loading table 37 to the lowering sensor 27. The lifting-lowering motor 68 rotates to lower the loading table 37 to a proper position. When the loading table 37 stops at the proper position, the hook 35*a* holds the tail end of the stapled sheets P in the sheet conveyance direction. When a substantial number of booklets formed of the stapled sheets P are placed on the loading table 37, especially when the booklets are made by stapling a small number of sheets at several or more positions, the stapling positions on the booklets are bulged, which may result in improper aligning and stapling operations for following sheets P. To prevent this, the hook 35*a* presses the bulged positions on the booklets.

Figure 12A:
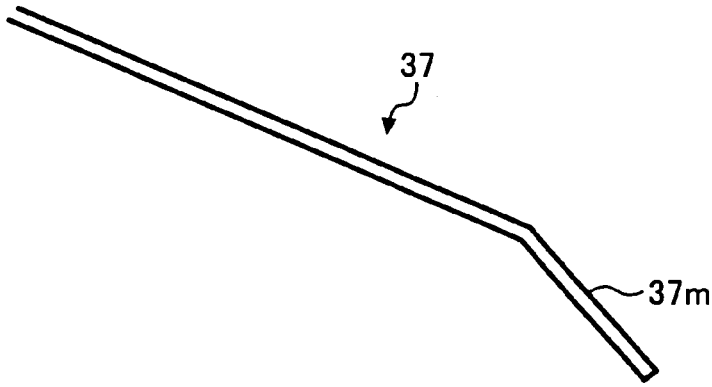
FIG. 12A is an illustration of a loading table of the loading portion shown in FIG. 11.

As illustrated in FIG. 12A, the loading table 37 includes an end portion 37*m*. The end portion 37*m* faces the stapling positions on the booklets and is formed in a shape bending downward to absorb the bulge of the booklets. Thus, the hook 35*a* also functions as an absorber of the bulge.

Figure 12B:
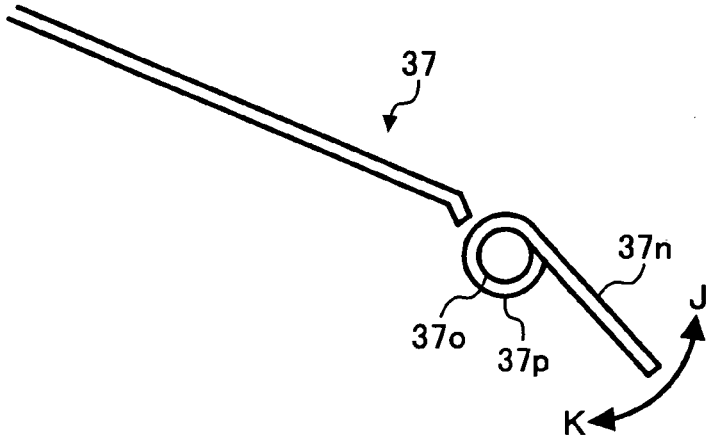
FIG. 12B is an illustration of another loading table of the loading portion shown in FIG. 11.

If the end portion 37*m* cannot absorb the bulge, the loading table 37 may include an end portion 37*n* instead of the end portion 37*m*, a shaft 37*o*, and a coil spring 37*p* as illustrated in FIG. 12B. The end portion 37*n* is configured to swing to support the loading table 37. The shaft 37*o* is configured to support the end portion 37*n*. The coil spring 37*p* is configured to apply a force to the shaft 37*o* so that the end portion 37*n* swings in a direction J (i.e., counterclockwise). At an initial position (i.e., a standby position), the end portion 37*n* forms an angle similar to that formed by the end portion 37*m* with respect to the loading table 37. While the end portion 37*n* is at the initial position, the stapling positions are bulged when a plurality of booklets produced by stapling the sheets P are stacked on the loading table 37. However, when the hook 35*a* presses the plurality of booklets, the end portion 37*n* swings in a direction K to relieve a pressure applied by the hook 35*a*, preventing improper aligning and stapling operations for following sheets P.

Figure 12C:
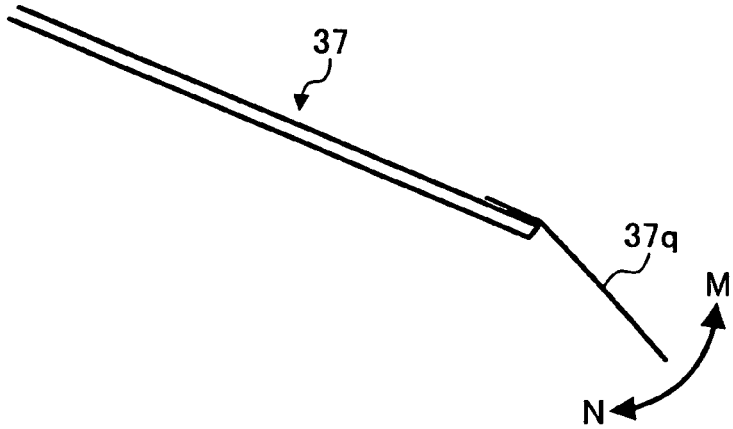
FIG. 12C is an illustration of yet another loading table of the loading portion shown in FIG. 11.

As illustrated in FIG. 12C, the end portion 37*n* may be modified into an end portion 37*q*. The end portion 37*q* includes an elastic material and is configured to relieve a pressure applied by the hook 35*a*. The end portion 37*q* is elastically deformed in a direction N to relieve the pressure applied by the hook 35*a* onto the bulged stapling positions. When the pressure is not applied by the hook 35*a*, the end portion 37*q* swings in a direction M to return to an initial position (i.e., a standby position).

Figure 13:
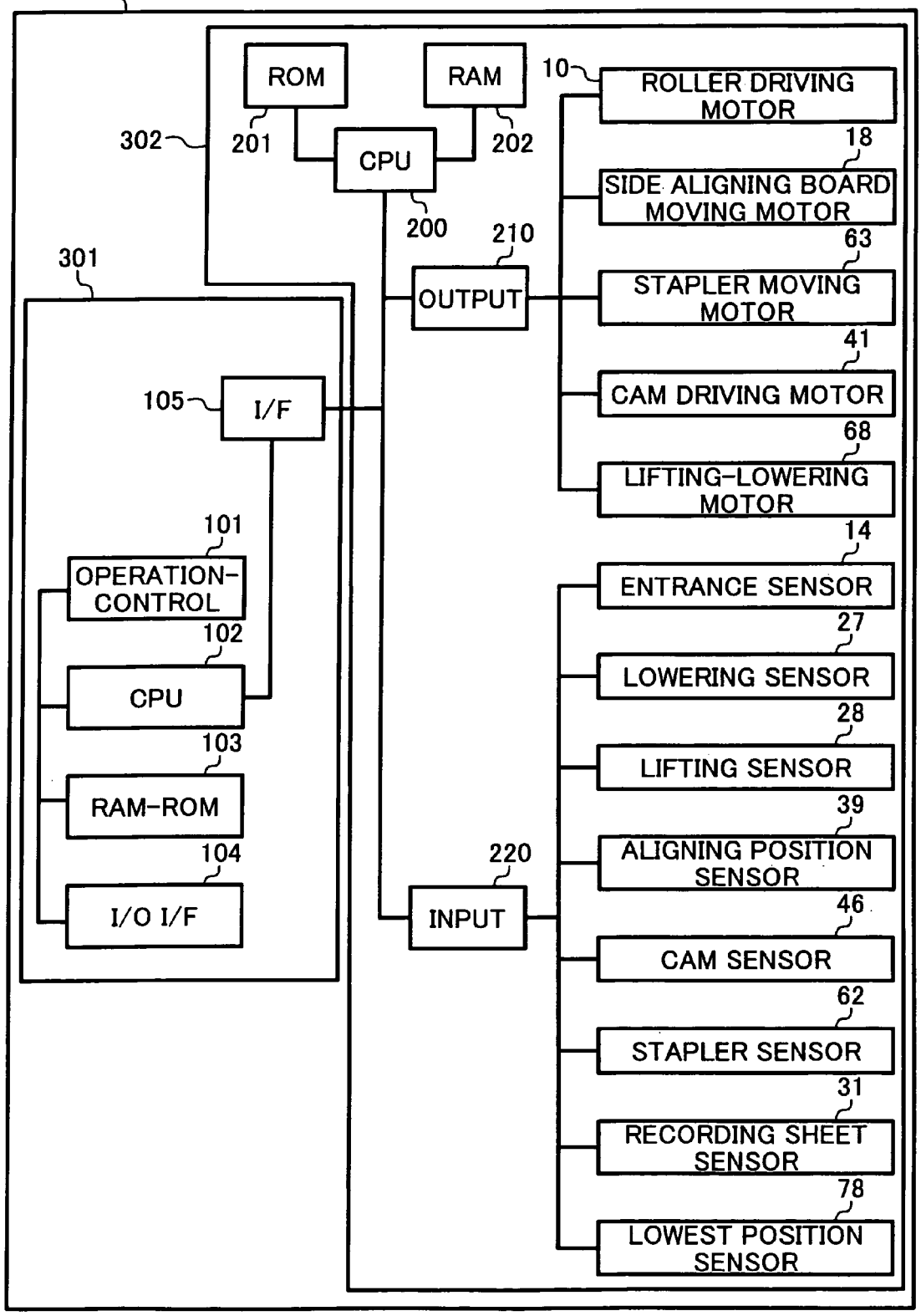
FIG. 13 is a block diagram of a control system of the image forming apparatus and the sheet processing apparatus shown in FIG. 1.

FIG. 13 illustrates a control system 3 including controllers of the image forming apparatus 1 and the sheet processing apparatus 2 according to this non-limiting embodiment.

The controller of the image forming apparatus 1, i.e., an image forming apparatus controller 301, basically includes an operation-control 101, a CPU (central processing unit) 102, a RAM (random-access memory)-ROM (read-only memory) 103, an input-output interface (I/O I/F) 104, and an interface (I/F) 105. The controller of the sheet processing apparatus 2, i.e., a sheet processing apparatus controller 302, basically includes a CPU 200, a ROM 201, a RAM 202, an output 210, and an input 220.

The control system 3 is configured to control the image forming apparatus 1 and the sheet processing apparatus 2. The image forming apparatus controller 301 is configured to control the image forming apparatus 1. The sheet processing apparatus controller 302 is configured to control the sheet processing apparatus 2.

The operation-control 101 is configured to receive from a user of the image forming apparatus 1 a command for operating the image forming apparatus 1. The CPU 102 is configured to control the image forming apparatus 1. The RAM-ROM 103 is configured to store a control program to be executed by the CPU 102 and data used for executing the program. The input-output interface 104 is configured to interface the CPU 102 with devices to be controlled by the CPU 102. The interface 105 is configured to interface the CPU 102 with the CPU 200.

The CPU 200 is connected with the CPU 102 via the interface 105 and is configured to control the sheet processing apparatus 2. The ROM 201 is configured to store a control program to be executed by the CPU 200. The RAM 202 provides a work area where the CPU 200 executes the program stored in the ROM 201 and is configured to store data used for executing the program. The output 210 is configured to interface the CPU 200 with devices to be controlled by the CPU 200. The input 220 is configured to send information required for controlling the devices to the CPU 200.

Devices connected with the output 210 include motors such as a roller driving motor 10 for rotating the upper roller 15 and the lower roller 16, the side aligning board moving motor 18, the stapler moving motor 63, the cam driving motor 41, and the lifting-lowering motor 68. Devices connected with the input 220 include sensors such as the entrance sensor 14, the lowering sensor 27, the lifting sensor 28, the aligning position sensor 39, the cam sensor 46, the stapler sensor 62, the sheet sensor 31, and the lowest position sensor 78. Thus, the CPU 200 receives detection information from the sensors via the input 220 and sends driving (i.e., controlling) signals to the motors to be controlled via the output 210 based on the detection information.

Figure 14A:
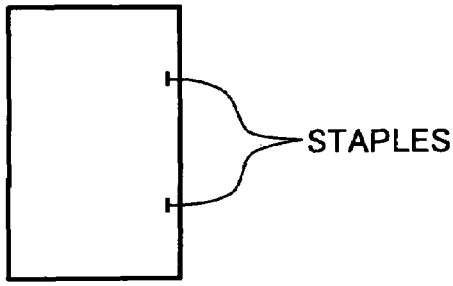
FIGS. 14A, 14B, and 14C illustrate stapling options of the sheet processing apparatus shown in FIG. 2.
Figure 14B:
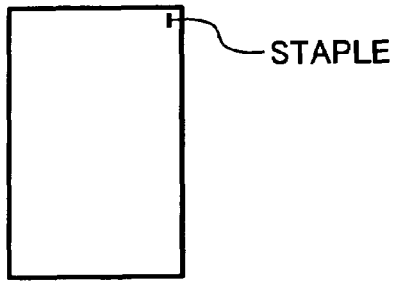
Figure 14C:
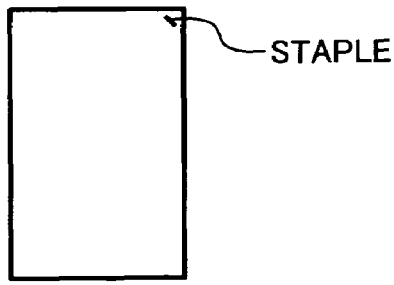
Figure 14D:
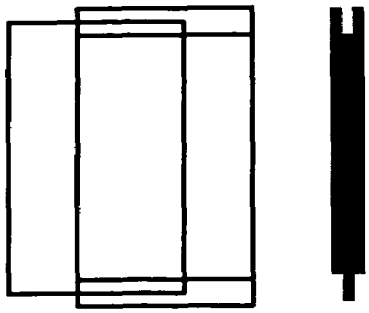
FIG. 14D illustrates a shifting option of the sheet processing apparatus shown in FIG. 2.

FIGS. 14A, 14B, 14C, and 14D illustrate stapling and shifting options configured in accordance with operation-control information selected or specified by the image forming apparatus 1. A user of the image forming apparatus 1 can arbitrarily select or specify a stapling position, a stapling angle, and a number of stapling positions by using a control panel (not shown) of the operation-control 101. Stapling options are not limited to those illustrated in FIGS. 14A, 14B, and 14C but any other stapling options can be added. FIG. 14A illustrates an option for stapling at two positions in the center near a vertical edge of a sheet P. FIG. 14B illustrates an option for putting a staple near an upper corner and in parallel to a vertical edge of a sheet P. FIG. 14C illustrates an option for putting a staple near an upper corner and obliquely to a vertical edge of a sheet P. FIG. 14D illustrates an option for alternately shifting booklets formed of stapled sheets P in the direction perpendicular to the sheet conveyance direction. The option shown in FIG. 14D further includes alternately shifting booklets formed of unstapled sheets P in the direction perpendicular to the sheet conveyance direction.

The other operation-control information includes sheet size, stapling or not stapling, shifting or not shifting, a number of the sheets P, a number of booklets to be produced, and an orientation of the sheets P or booklets to be produced. After the above information is sent from the image forming apparatus 1 to the sheet processing apparatus 2, the sheet processing apparatus 2 enters into a standby mode. In the standby mode, each of the side aligning boards 25 waits at a position away by a predetermined length (e.g., about 5 mm) from a sheet P to be conveyed from the image forming apparatus 1. The stapler 38 waits at a predetermined stapling position. The loading table 37 moves up to a highest position where the sheet sensor 31 can properly detect the sheet P placed on the loading table 37 and waits at the highest position. The pushing board 35 waits at the position A as illustrated in FIG. 9. The backing vane 30 stops and waits at a position where the backing vane 30 does not contact the loading table 37.

Figures 15, 15A:
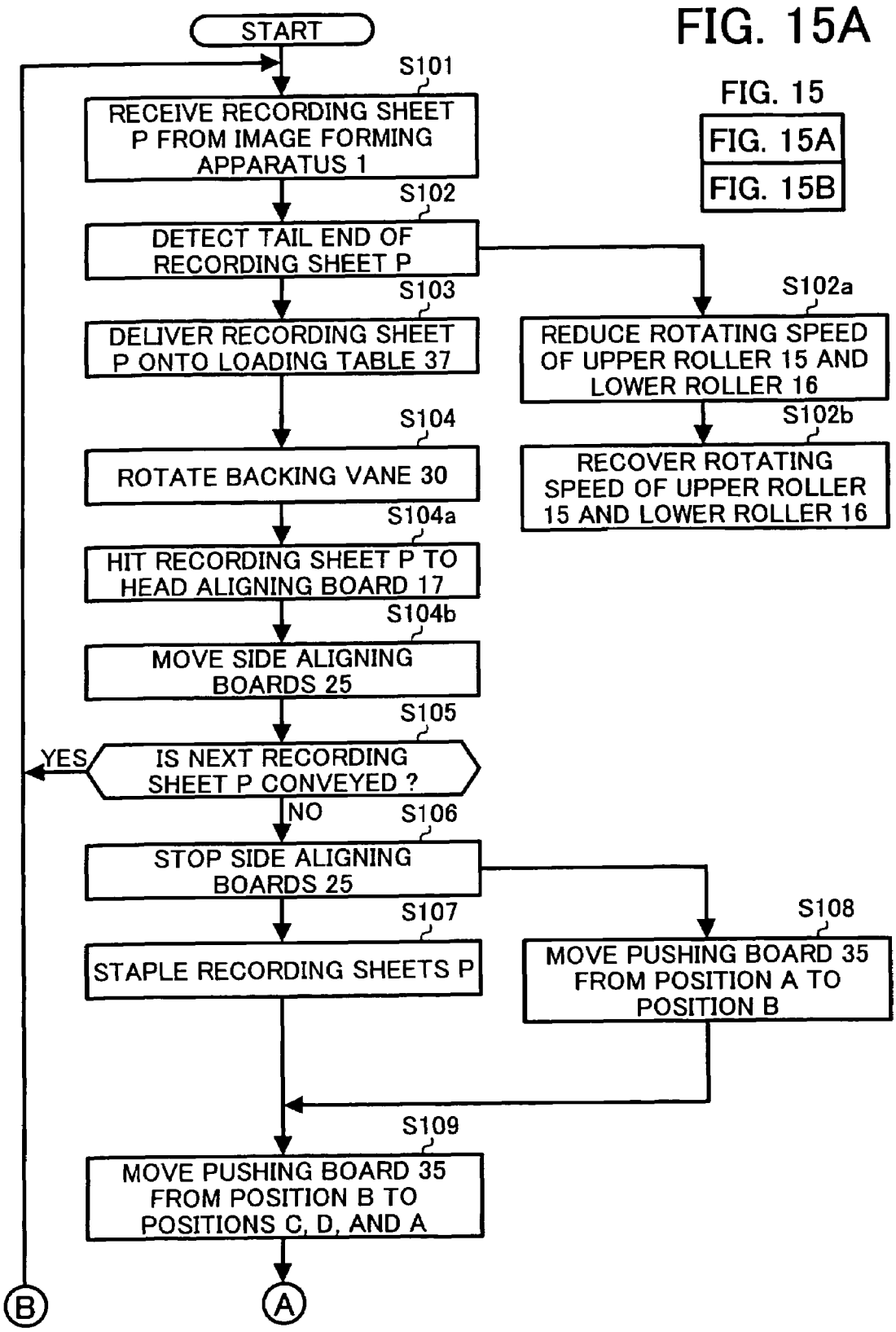
FIGS. 15A and 15B are a flowchart illustrating operations of the sheet processing apparatus shown in FIG. 2.
Figure 15B:
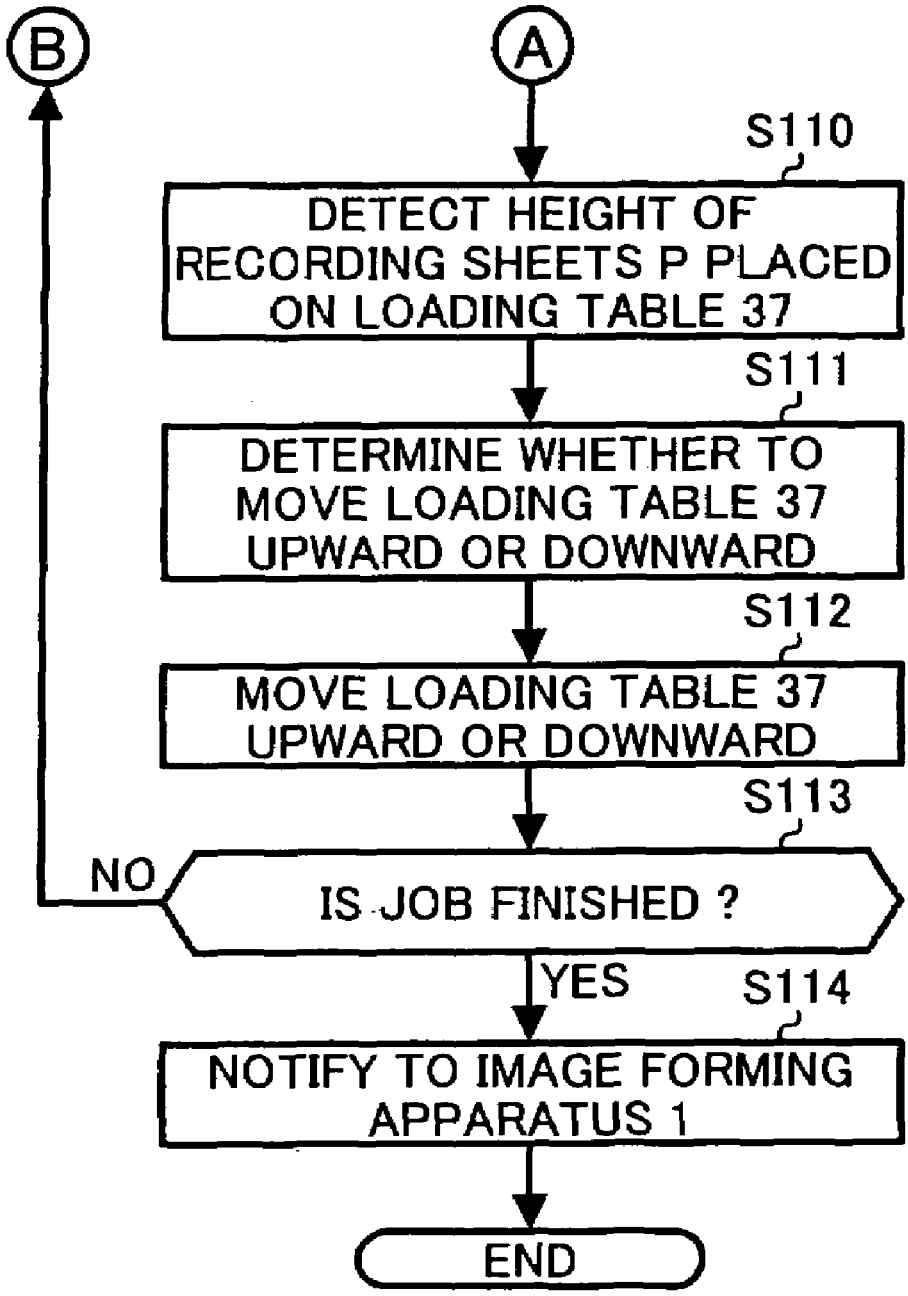

FIGS. 15A, 15B illustrate a flowchart of operations for a bookbinding job of the image forming apparatus 1 and the sheet processing apparatus 2 according to this non-limiting embodiment. In a step S101, the upper roller 15 and the lower roller 16 receive a sheet P sent from the image forming apparatus 1 at a speed similar to that at which the sheet P is conveyed inside the image forming apparatus 1. In a step S102, which includes substeps S102*a*, S102*b*, the entrance sensor 14 detects the tail end of the sheet P in the sheet conveyance direction. In a substep S102*a*, the rotating speed of the upper roller 15 and the lower roller 16 is reduced to a predetermined speed when a predetermined time period elapses after the entrance sensor 14 detects the tail end of the sheet P. In a substep S102*b*, the reduced rotating speed of the upper roller 15 and the lower roller 16 is recovered to an original speed after the tail end of the sheet P in the sheet conveyance direction passes between the upper roller 15 and the lower roller 16. In a step S103, the sheet P is delivered onto the loading table 37. At this moment, the tail end of the sheet P in the sheet conveyance direction does not pass the hook 35*a* disposed in the top end of the pushing board 35.

In a step S104, a motor (not shown) drives the clutch 76 to rotate the backing vane 30. In a step S104*a*, the rotating backing vane 30 causes the sheet P to hit the head aligning board 17. Thus, the rotating backing vane 30 and the head aligning board 17 align the sheet P in the sheet conveyance direction. In a step S104*b*, when the sheet P hits the head aligning board 17, the side aligning boards 25 disposed on both sides of the sheet P in the direction perpendicular to the sheet conveyance direction move to align the sheet P in the direction perpendicular to the sheet conveyance direction. If a next sheet P is to be conveyed from the image forming apparatus 1 (i.e., if YES is selected in a step S105), the side aligning boards 25 return to predetermined positions and stop to wait for the next sheet P. The above operations S101-S105 are repeated until all sheets P required for producing a booklet are received and aligned by the head aligning board 17.

When all the sheets P required for producing a booklet are received by the head aligning board 17 (i.e., if NO is selected in the step S105), the side aligning boards 25 stop in a state that the side aligning boards 25 respectively contact the both sides of the sheets P in the direction perpendicular to the sheet conveyance direction after aligning the sheets P to hold the sheets P in a step S106. In a step S107, the stapler 38 performs a specified stapling.

In a step S108, when the stapling starts, the pushing board 35 almost simultaneously moves from the position A to the position B as illustrated in FIG. 9. In a step S109, the pushing board 35 moves upward to the position C. The operations of the cam and fast return mechanisms for the pushing board 35 are described above by referring to FIG. 10. The pushing board 35 receives the stapled sheets P from the head aligning board 17 and delivers the stapled sheets P onto the loading table 37. The pushing board 35 moves from the position C to the position D at a speed slower than that at which the pushing board 35 moves from the position A to the position B. The pushing board 35 moves downward from the position D to the position A. The hook 35*a* presses the stapled sheets P onto the loading table 37. Then, in a step S110, the sheet sensor 31 detects a height of the stapled sheets P placed on the loading table 37. In a step S111, whether the loading table 37 needs to be moved upward or downward is determined based on the height of the stapled sheets P detected in the step S110. In a step S112, the lifting-lowering motor 68 moves the loading table 37 upward or downward. Following stapled sheets P are stacked on the stapled sheets P previously delivered onto the loading table 37. In a step S113, whether the current bookbinding job is finished or not is determined. If the current bookbinding job is finished (i.e., if YES is selected in the step S113), a finishing operation, such as notification to the image forming apparatus 1, is performed in a step S114, otherwise the operation returns to step S101.

Then, the upper roller 5 and the lower roller 6 receive a first sheet P for a next bookbinding job to start another operations for the next bookbinding job.

According to this non-limiting embodiment, the sheet processing apparatus 2 can be separated from the image forming apparatus 1 and is connected with the image forming apparatus 1 for usage. However, the sheet processing apparatus 2 may be integrated with the image forming apparatus 1.

As described above, the image forming apparatus 1 and the sheet processing apparatus 2 according to this non-limiting embodiment can provide simple and compact bookbinding by using a simple cam and fast return mechanisms replacing conventional mechanisms such as a delivery mechanism using a roller.

Figure 16:
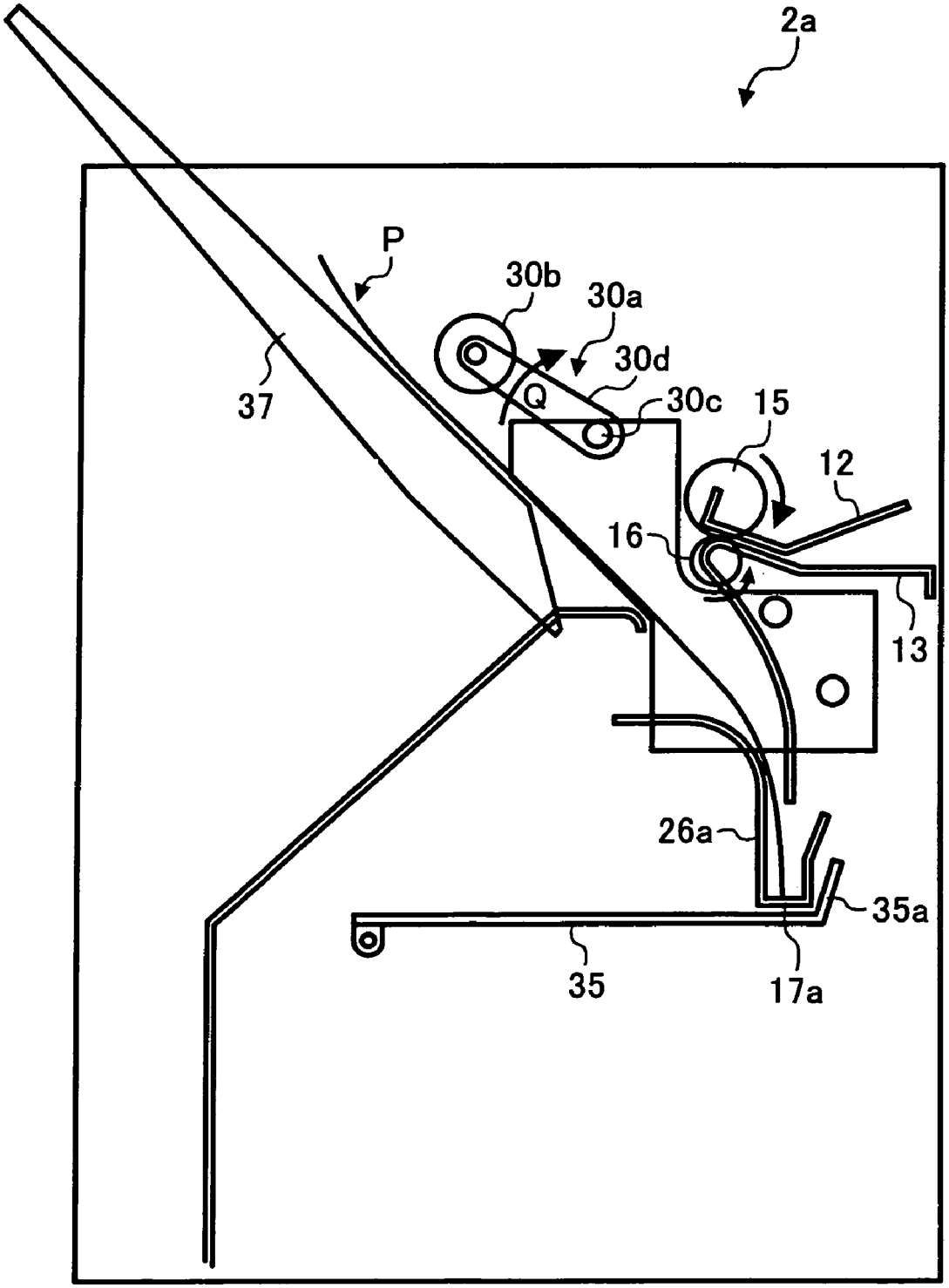
FIG. 16 is a sectional view of a sheet processing apparatus according to another exemplary embodiment of the present invention.

FIG. 16 partially illustrates a schematic view of a sheet processing apparatus 2*a* according to another exemplary embodiment of the present invention. As illustrated in FIG. 16, the sheet processing apparatus 2*a* includes a head aligning board 17*a* instead of the head aligning board 17, a bottom aligning board 26*a* instead of the bottom aligning board 26, and a backing device 30*a* instead of the backing vane 30. The backing device 30*a* includes a backing roller 30*b*, a swinging axis 30*c*, and a swinging lever 30*d*.

The backing device 30*a* is configured to send a sheet P fed by the upper roller 15 and the lower roller 16 to the bottom aligning board 26*a* and the head aligning board 17*a*. The swinging axis 30*c* is configured to support the swinging lever 30*d*. The swinging lever 30*d* is configured to swing to send the sheet P toward the head aligning board 17*a*. The backing roller 30*b* is disposed on one end of the swinging lever 30*d* and is configured to rotate to feed the sheet P toward the head aligning board 17*a*. The bottom aligning board 26*a* is configured to receive the sheet P sent by the backing device 30*a*. The head aligning board 17*a* is configured to align the sheet P hit thereto.

According to the previous embodiment, a top surface of the loading table 37 is disposed substantially parallel to a surface of the bottom aligning board 26. Namely, the surfaces of the loading table 37 and the bottom aligning board 26 have a similar inclination. According to this non-limiting embodiment, however, the head aligning board 17*a* is substantially horizontally disposed in a state that a surface of the head aligning board 17*a* is substantially vertical to a surface of the bottom aligning board 26*a*.

Figure 17:
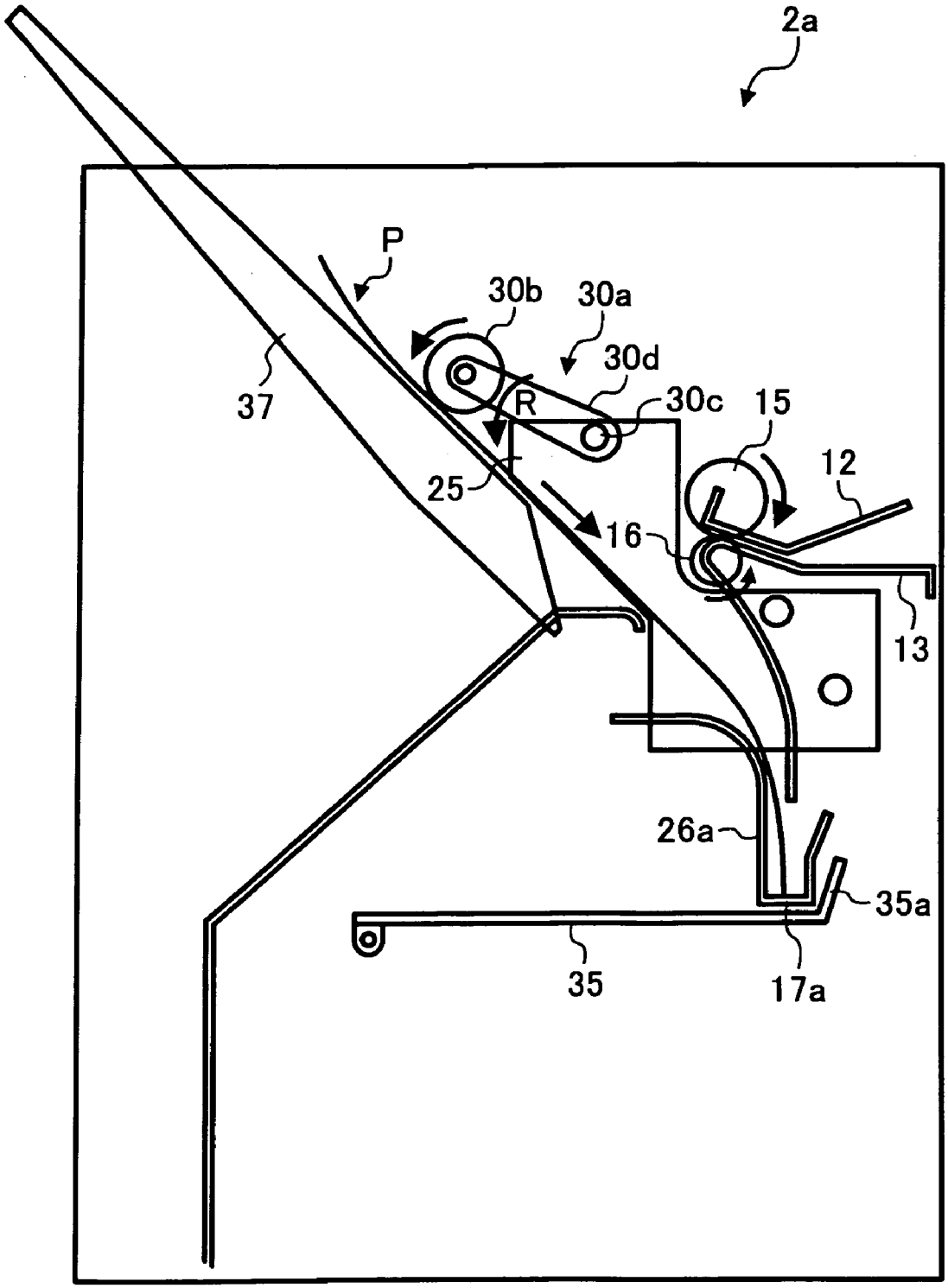
FIG. 17 is a sectional view of the sheet processing apparatus shown in FIG. 16 feeding back a sheet.

The backing device 30*a* sends a sheet P conveyed from the image forming apparatus 1 toward the head aligning board 17*a*. A head edge of the sheet P contacts the head aligning board 17*a* and the sheet P is aligned in the sheet conveyance direction. The sheet P is guided by the upper guide board 12 and the lower guide board 13 and is fed between the upper roller 15 and the lower roller 16. When the sheet P is delivered onto the loading table 37, the swinging lever 30*d* swings in a direction Q to lead the sheet P onto the loading table 37. A weight of the sheet P causes the head edge of the sheet P to contact the head aligning board 17*a*. To prevent the head edge of the sheet P from not reaching the head aligning board 17*a* or to prevent the sheet P from slanting due to friction or static electricity, the swinging lever 30*d* swings in a direction R to cause the rotating backing roller 30*b* to forcibly feed the sheet P so that the head edge of the sheet P contacts the head aligning board 17*a* and is aligned as illustrated in FIG. 17. A stepping motor (not shown) drives the backing roller 30*b* to rotate and a solenoid (not shown) drives the swinging lever 30*d*.

Figure 18:
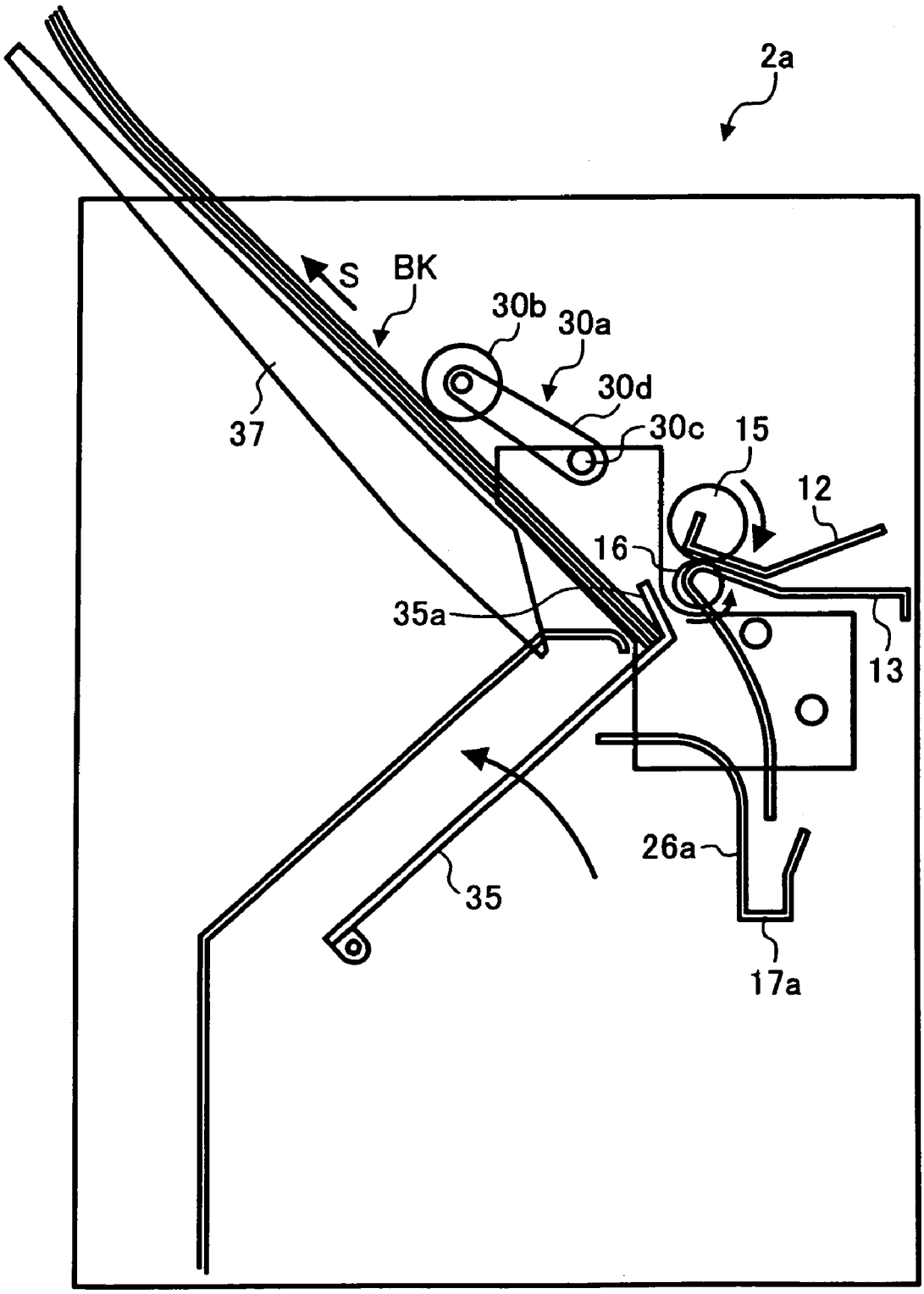
FIG. 18 is a sectional view of the sheet processing apparatus shown in FIG. 16 pushing sheets.

When the sheets P to form a booklet BK (FIG. 18) are prepared by repeating the above-described operations, the stapler 38 staples the sheets P on their edge portion as described according to the previous embodiment. The pushing board 35 positioned in a horizontal direction as illustrated in FIGS. 16 and 17 pushes up the booklet BK in a direction S onto the loading table 37 as illustrated in FIG. 18. The mechanisms and operations of the pushing board 35 according to the previous embodiment can be applied to the pushing board 35 according to this non-limiting embodiment.

Figure 19:
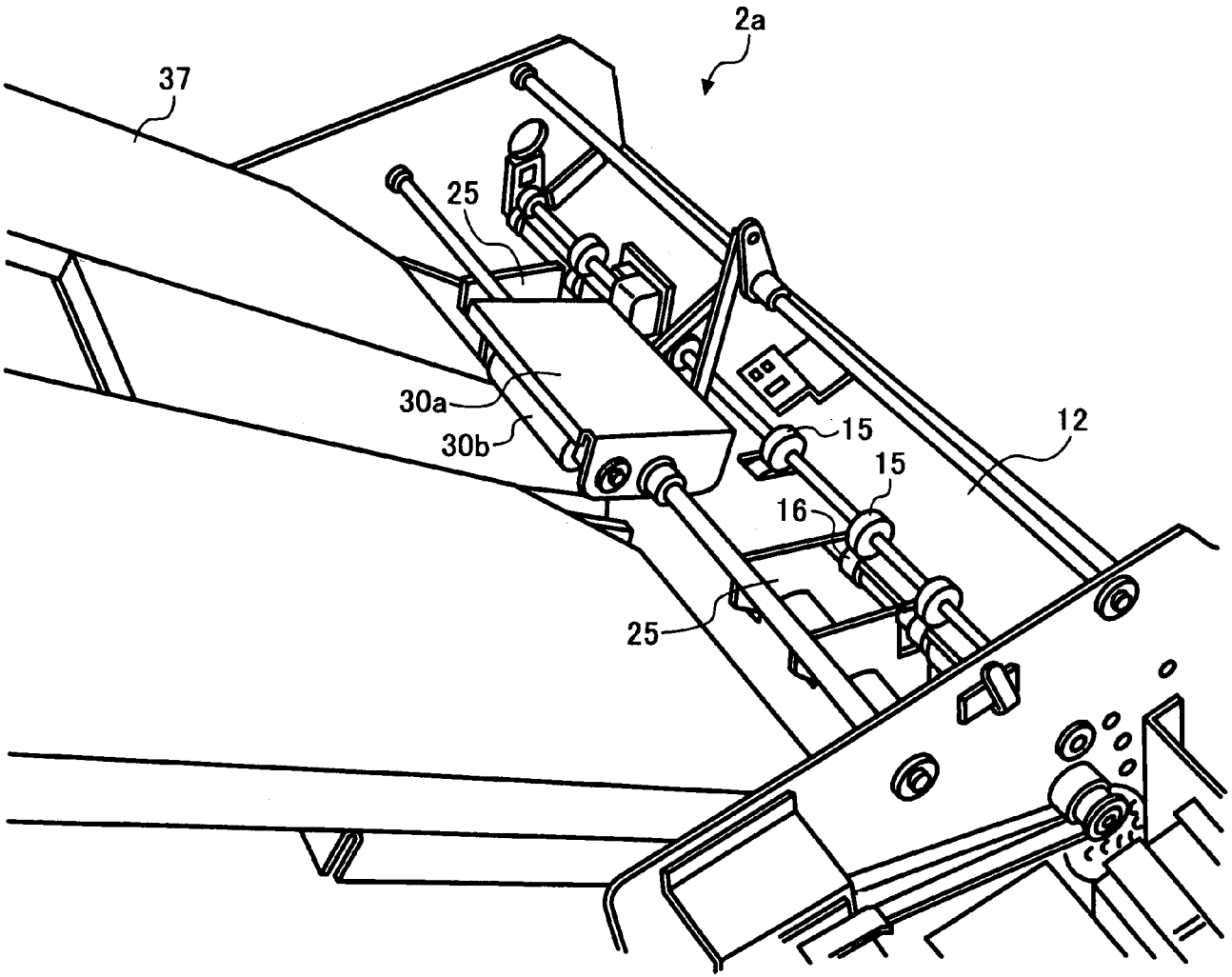
FIG. 19 is a perspective view of the sheet processing apparatus shown in FIG. 16.

FIG. 19 is a perspective view of parts used for sending the sheet P onto the loading table 37. The backing device 30*a* is disposed in a center in the direction perpendicular to the sheet conveyance direction above the loading table 37. The sheet P is fed by the upper roller 15 and the lower roller 16 onto the loading table 37.

Figure 20:
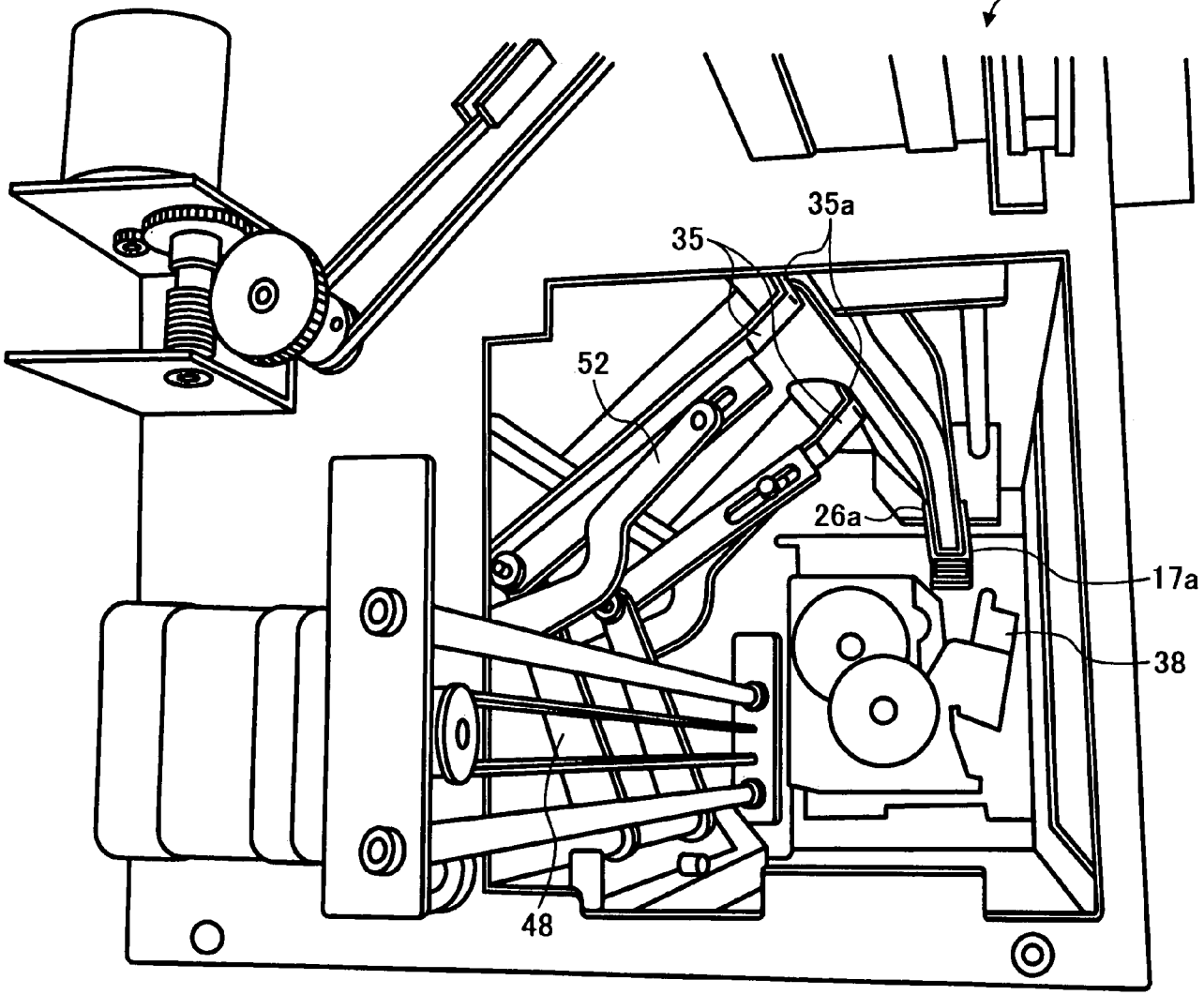
FIG. 20 is a side view of the sheet processing apparatus shown in FIG. 16.

FIG. 20 illustrates the pushing board 35 having pushed the booklet BK up onto the loading table 37. In this state, the stapler 38 is retreated and the pushing board 35 contacts a lower end of the loading table 37.

According to this non-limiting embodiment, the sheet processing apparatus 2*a* can more effectively align the head edge of the sheet P by using the weight of the sheet P than the sheet processing apparatus 2 according to the previous embodiment.

According to this non-limiting embodiment, structures and functions of the other parts not described above are similar to those of the sheet processing apparatus 2 according to the previous embodiment.

Figure 21:
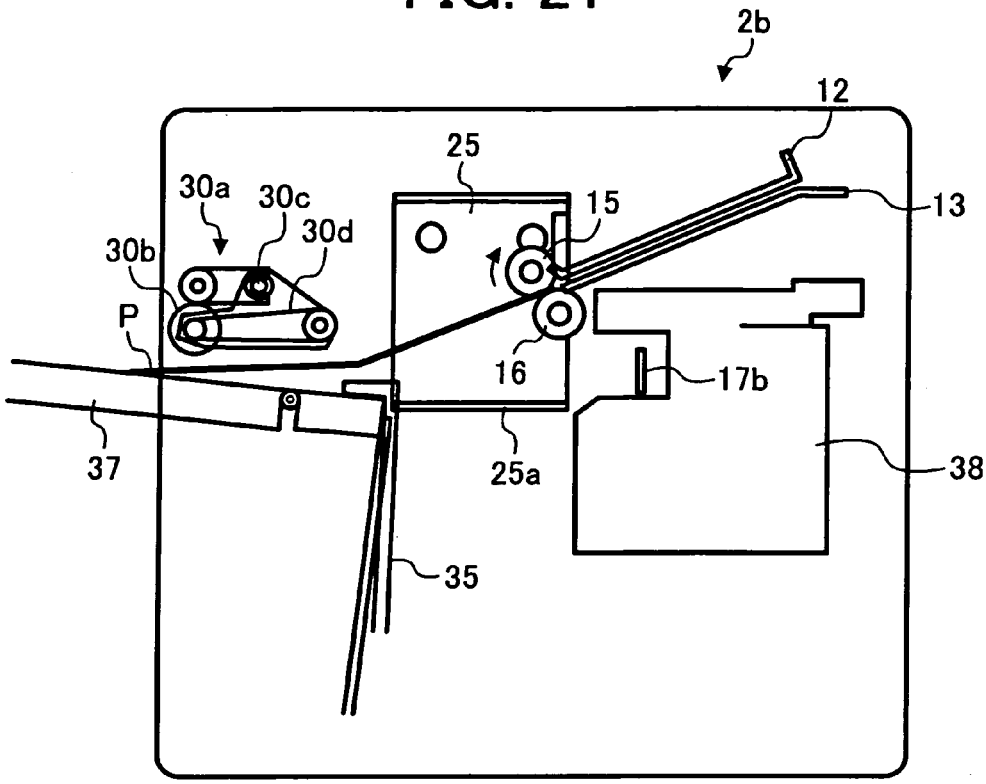
FIG. 21 is a sectional view of a sheet processing apparatus according to yet another exemplary embodiment of the present invention.

FIG. 21 partially illustrates a schematic view of a sheet processing apparatus 2*b* according to yet another exemplary embodiment of the present invention. As illustrated in FIG. 21, the sheet processing apparatus 2*b* includes a head aligning board 17*b* instead of the head aligning board 17 and further includes a horizontal portion 25*a*.

The horizontal portion 25*a* protrudes from a lower portion of the side aligning board 25 in a horizontal direction and is configured to receive a sheet P. The head aligning board 17*b* is configured to align the sheet P in contact thereto.

In the sheet processing apparatus 2 according to the preceding embodiment, the top surface of the loading table 37 is disposed substantially parallel to the surface of the bottom aligning board 26 in a state that the surfaces of the loading table 37 and the bottom aligning board 26 form an arbitrary, non-limiting angle of about 30 to 60 degrees, for example, with respect to a horizontal line. According to this non-limiting embodiment, however, the 4 loading table 37 forms a slight angle with respect to the horizontal line so that a head portion of the sheet P in a direction sending the sheet P toward the head aligning board 17*b* is horizontally positioned. Therefore, a surface of the head aligning board 17*b*, which contacts a head edge of the sheet P, is substantially vertically positioned. A top surface of the horizontal portion 25*a* receives and horizontally holds the sheet P.

Figure 22:
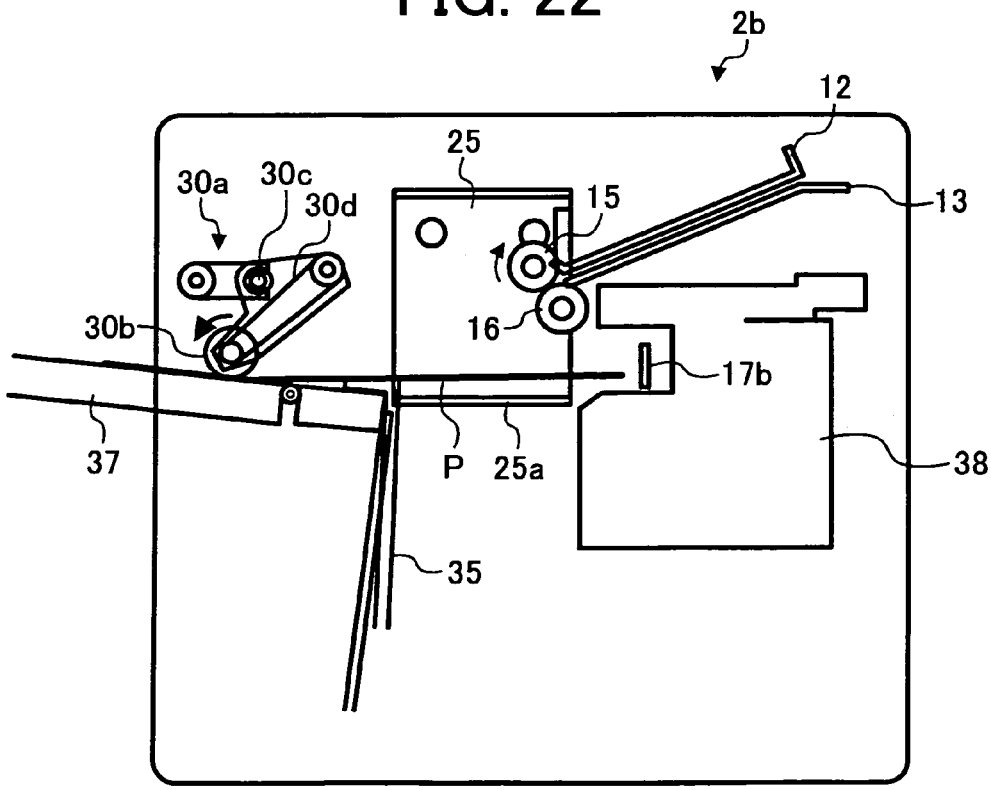
FIG. 22 is a sectional view of the sheet processing apparatus shown in FIG. 21 feeding back a sheet.
Figure 23:
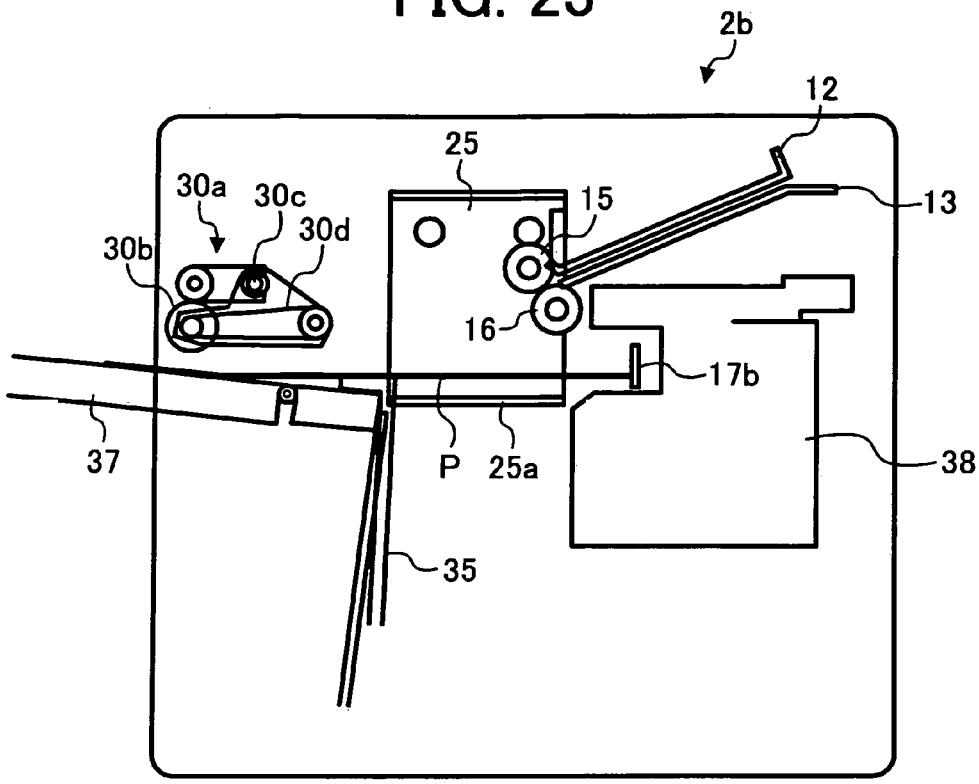
FIG. 23 is a sectional view of the sheet processing apparatus shown in FIG. 21 receiving another sheet.

As illustrated in FIG. 21, a sheet P conveyed from the image forming apparatus 1 is guided by the upper guide board 12 and the lower guide board 13 and is fed between the upper roller 15 and the lower roller 16. When the sheet P is delivered onto the loading table 37, the horizontal top surface of the horizontal portion 25*a* supports the head portion of the sheet P. As illustrated in FIG. 22, the backing roller 30*b* feeds the sheet P toward the head aligning board 17*b*. As illustrated in FIG. 23, the head edge of the sheet P contacts the head aligning board 17*b*. Thus, the head edge of the sheet P is aligned in the sheet conveyance direction. A structure and operations of the backing roller 30*b* are similar to those of the sheet processing apparatus 2*a* according to the previous embodiment.

Figure 24:
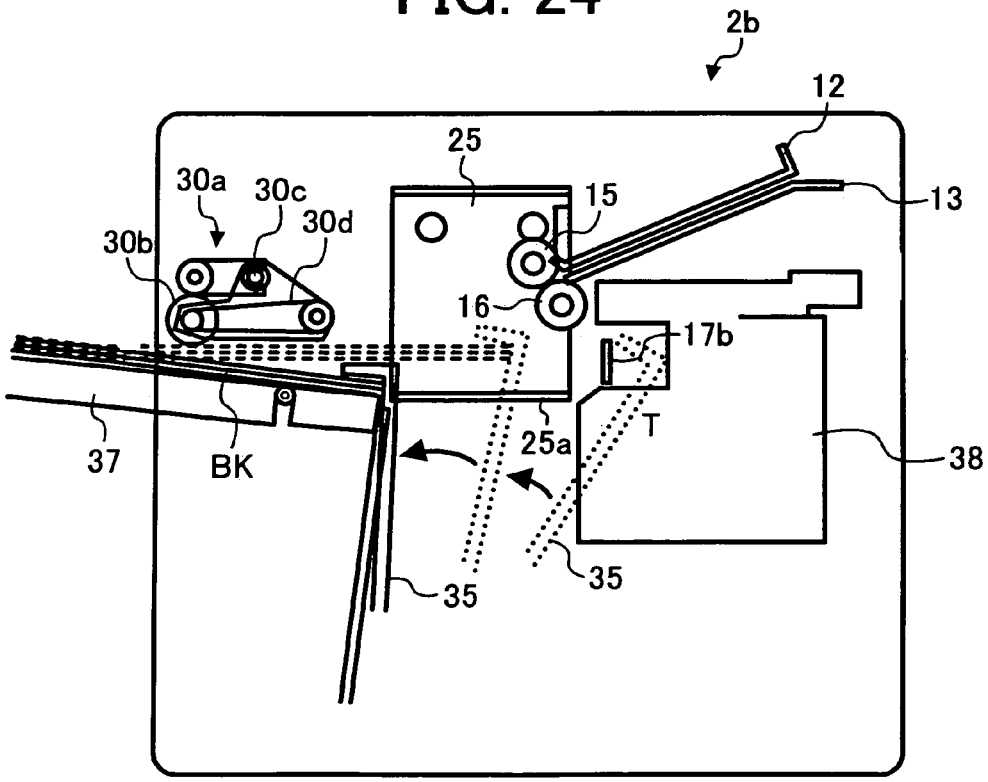
FIG. 24 is a sectional view of the sheet processing apparatus shown in FIG. 21 pushing sheets.

When sheets P to form a booklet BK are prepared by repeating the above-described operations, the stapler 38 staples the sheets P on their edge portion as described for the sheet processing apparatus 2 according to the preceding embodiment. The pushing board 35 positioned at an end of the loading table 37 as illustrated in FIG. 23 moves to a position T behind the head aligning board 17*b* as illustrated in FIG. 24 in accordance with the mechanisms of the sheet processing apparatus 2 according to the preceding embodiment. Then, the pushing board 35 pushes the head edges of the sheets P forming the booklet BK toward the loading table 37. Thus, the booklet BK is placed on the loading table 37. Mechanisms and operations of the pushing board 35 are similar to those of the sheet processing apparatus 2 according to the preceding embodiment.

Figure 25:
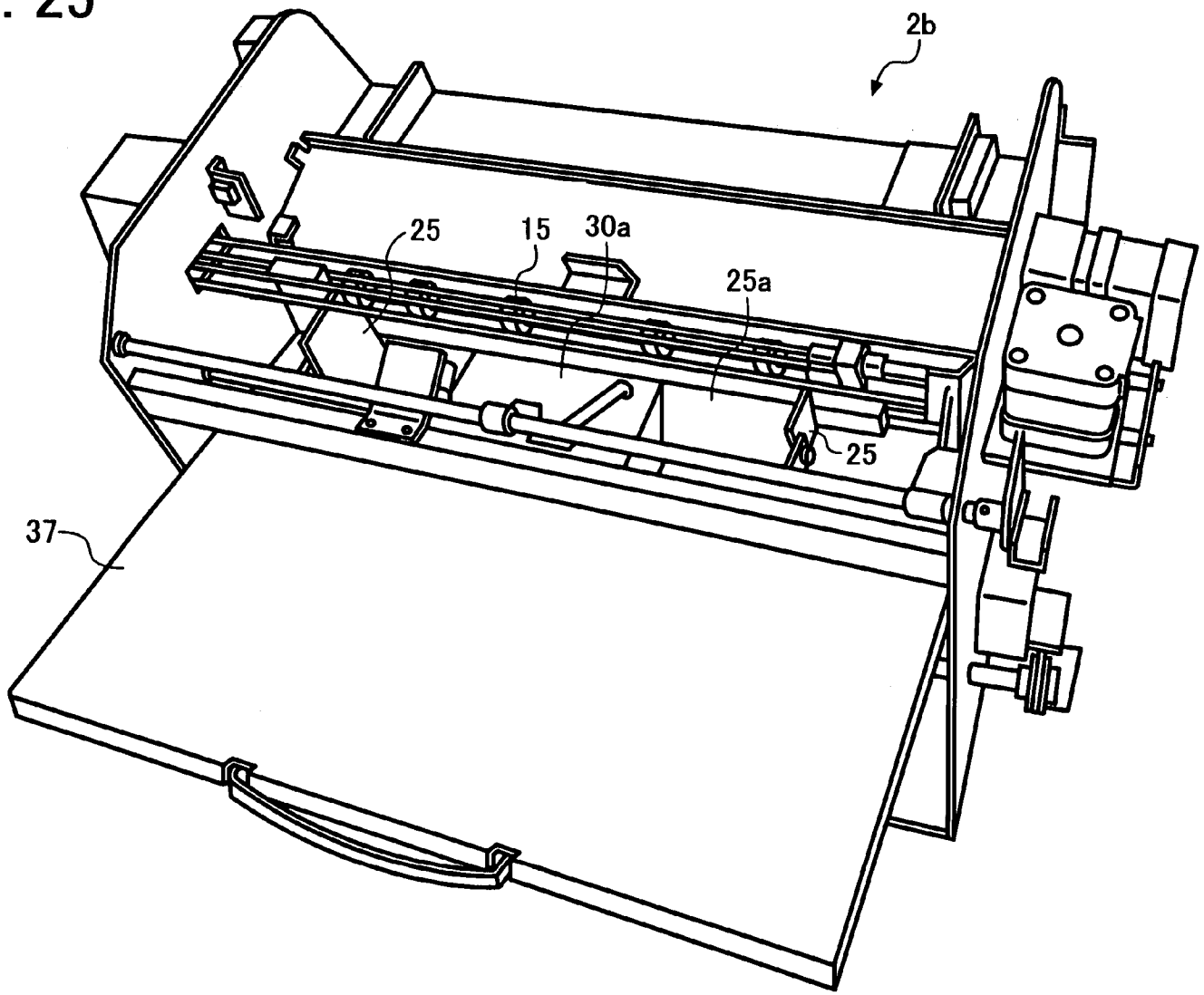
FIG. 25 is a top view of the sheet processing apparatus shown in FIG. 21.
Figure 26:
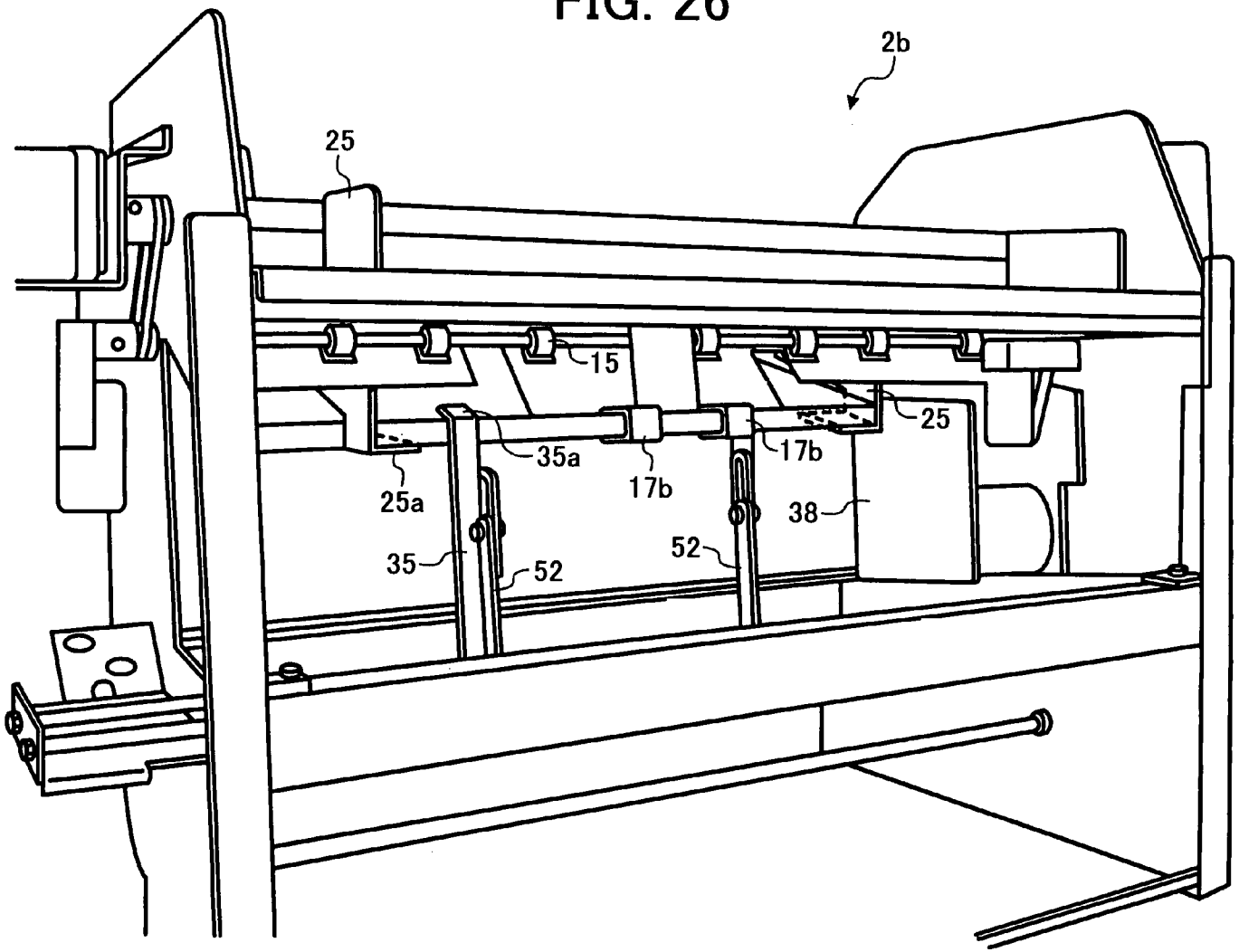
FIG. 26 is a side view of the sheet processing apparatus shown in FIG. 21.

FIG. 25 is a perspective view of parts used for sending the sheet P onto the loading table 37. FIG. 26 illustrates the pushing board 35 pushing the booklet BK toward the loading table 37. The head edges of the sheets P forming the booklet BK contact a vertical surface of the head aligning board 17*b* formed in a U-like shape in a sectional view and are aligned in the sheet conveyance direction. Then, the pushing board 35 contacts and pushes the head edges of the sheets P forming the booklet BK toward the loading table 37.

In the sheet processing apparatus 2*a* according to a previous embodiment, a soft sheet P may warp or buckle when a head edge of the soft sheet P contacts the head aligning board 17*a*. According to this non-limiting embodiment, however, the soft sheet P may neither warp nor buckle because the head edge of the soft sheet P contacts the head aligning board 17*b* in a state that a surface of the soft sheet P is substantially parallel to the horizontal line.

According to this non-limiting embodiment, structures and functions of the other parts not described above are similar to those of the sheet processing apparatus 2 according to the preceding embodiment.

Figure 27:
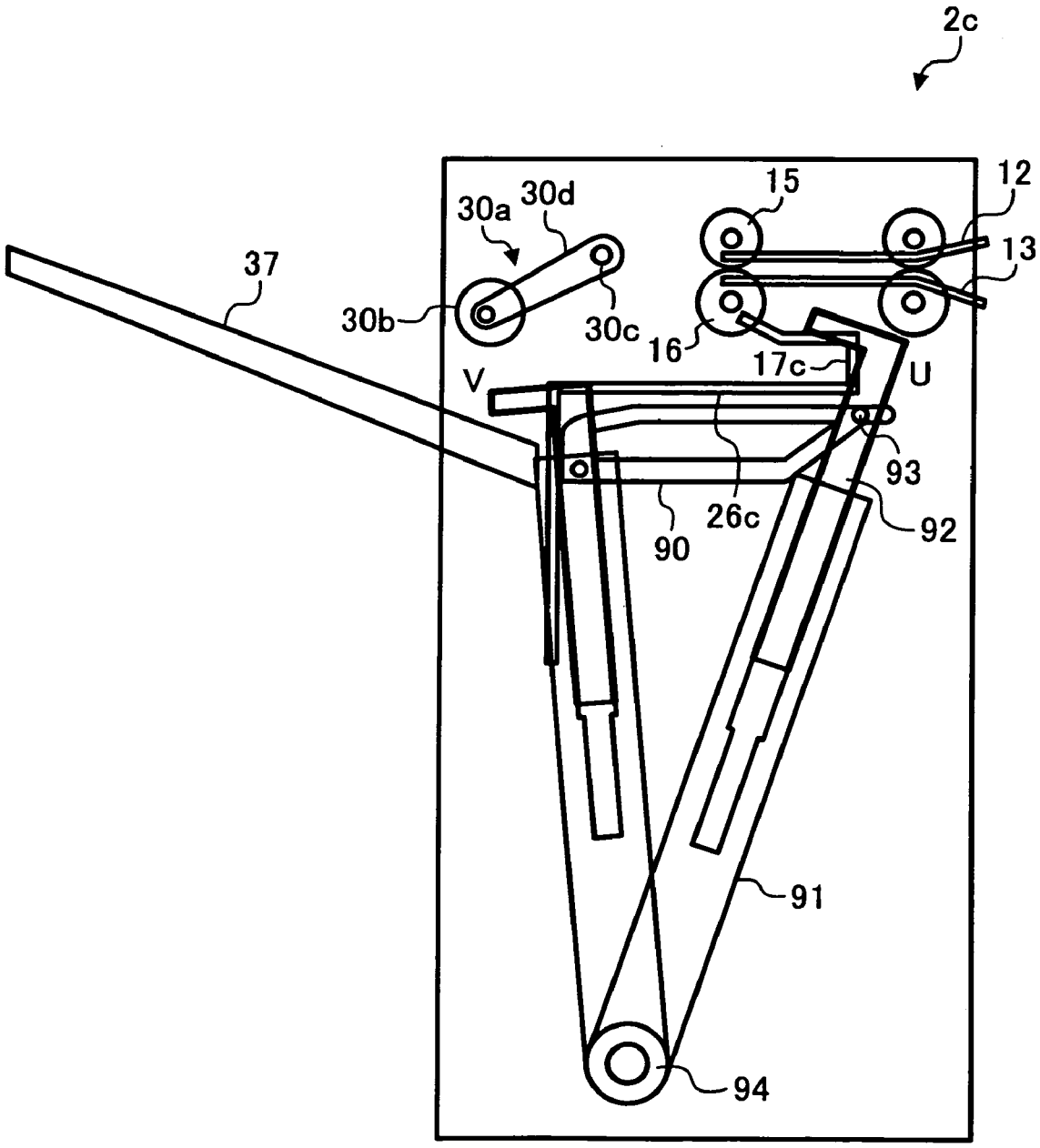
FIG. 27 is a sectional view of a sheet processing apparatus according to yet another exemplary embodiment of the present invention.

FIG. 27 partially illustrates a schematic view of a sheet processing apparatus 2*c* according to yet another exemplary embodiment of the present invention. As illustrated in FIG. 27, the sheet processing apparatus 2*c* includes a bottom aligning board 26*c* instead of the bottom aligning board 26 and a head aligning board 17*c* instead of the head aligning board 17, and further includes a rail 90, a pin 93, an axis 94, and a link 91 including an extension 92.

The bottom aligning board 26*c* is configured to receive a sheet P sent by the backing device 30*a*. The head aligning board 17*c* is configured to align the sheet P in contact thereto. The rail 90 is configured to form a rail along which the link 91 moves. The pin 93 protrudes from the extension 92 and is engaged with the rail 90 to move along the rail 90. The axis 94 is configured to support the link 91. The link 91 is configured to swing to move the extension 92. The extension 92 is configured to move upward from or move downward into the link 91 as moving along the rail 90.

According to this non-limiting embodiment, a mechanism for moving the link 91 along the rail 90 is employed instead of the cam mechanism for driving the pushing board 35 of the sheet processing apparatus 2 according to the preceding embodiment. The head aligning board 17*c* is vertically disposed and the bottom aligning board 26*c* is horizontally disposed. The extension 92 extends from or retracts into the link 91 through a top end of the link 91. A driving mechanism (not shown) drives the link 91 to swing about the axis 94. When the extension 92 is behind the head aligning board 17*c*, the extension 92 extends upward so that an upper portion of the extension 92 is positioned at a position U above a booklet BK (FIG. 29) formed of sheets P and placed on the bottom aligning board 26*c*. Then, the extension 92 extended upward moves the booklet BK toward the loading table 37. When the booklet BK is delivered onto the loading table 37, the extension 92 moves downward under the bottom aligning board 26*c* and is positioned at a position V to hold an edge of the booklet BK which faces the extension 92. Routes on which the top end of the extension 92 moves are similar to the routes on which the hook 35*a* of the sheet processing apparatus 2 moves according to the preceding embodiment. The extension 92 does not protrude above a surface of the bottom aligning board 26*c*, which receives a next sheet P fed by the backing device 30*a*. Therefore, the next sheet P can be immediately sent onto the bottom aligning board 26*c* so that a head edge of the sheet P contacts and is aligned by the head aligning board 17*c*.

Referring to FIGS. 27 to 30, operations of the mechanism according to this non-limiting embodiment are explained.

Figure 28:
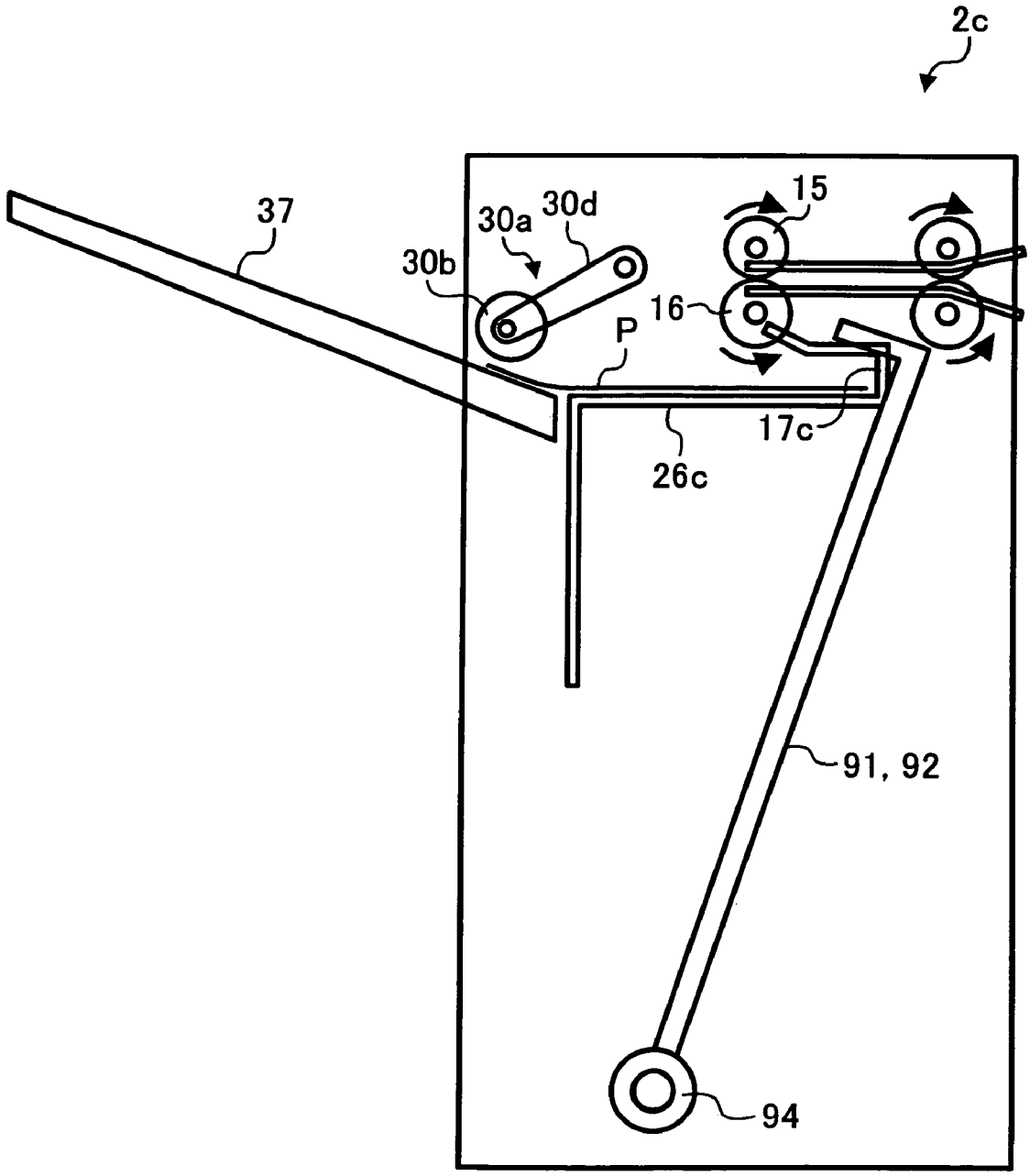
FIG. 28 is a sectional view of the sheet processing apparatus shown in FIG. 27 feeding back a sheet.
Figure 29:
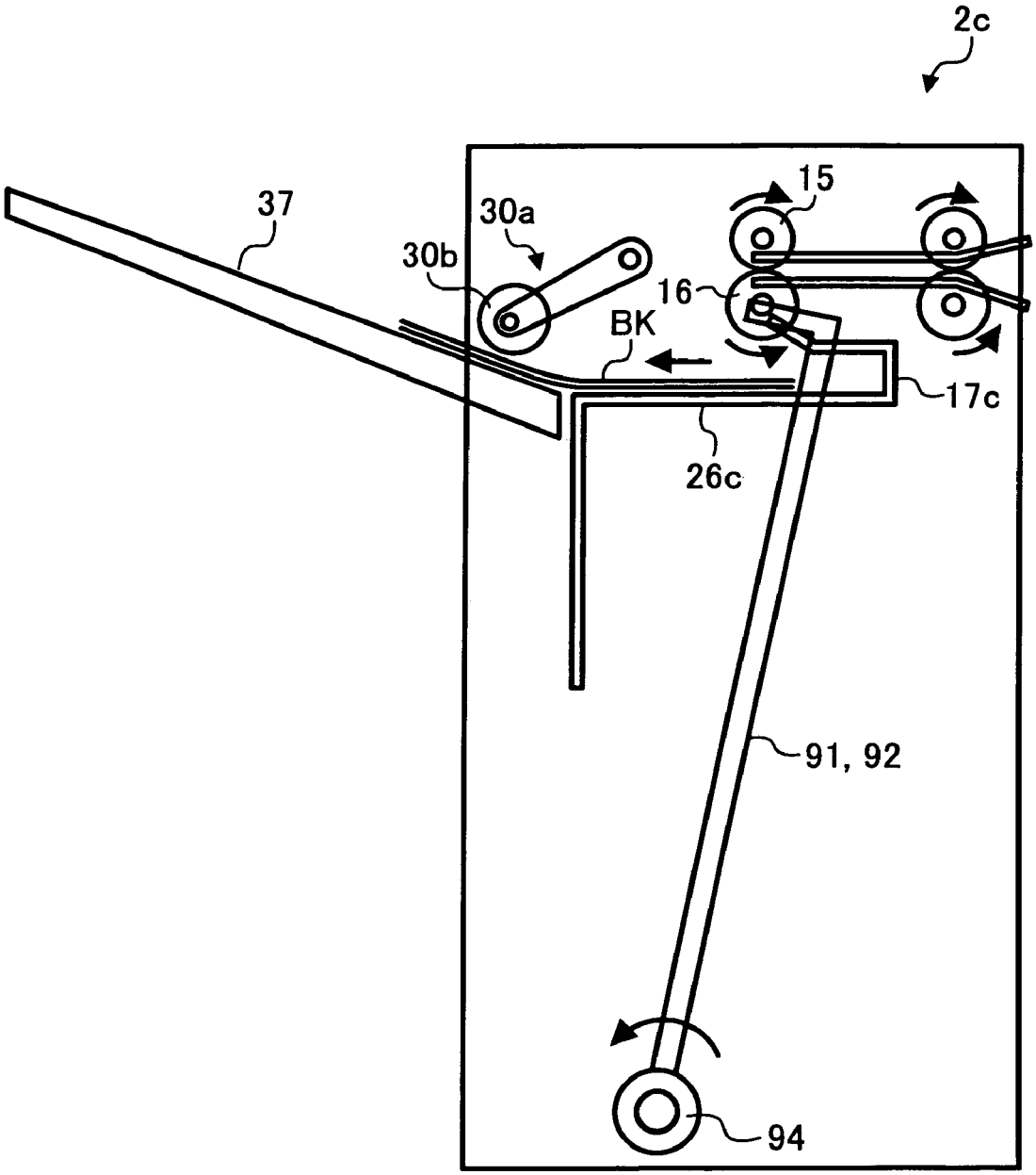
FIG. 29 is a sectional view of the sheet processing apparatus shown in FIG. 27 pushing sheets.
Figure 30:
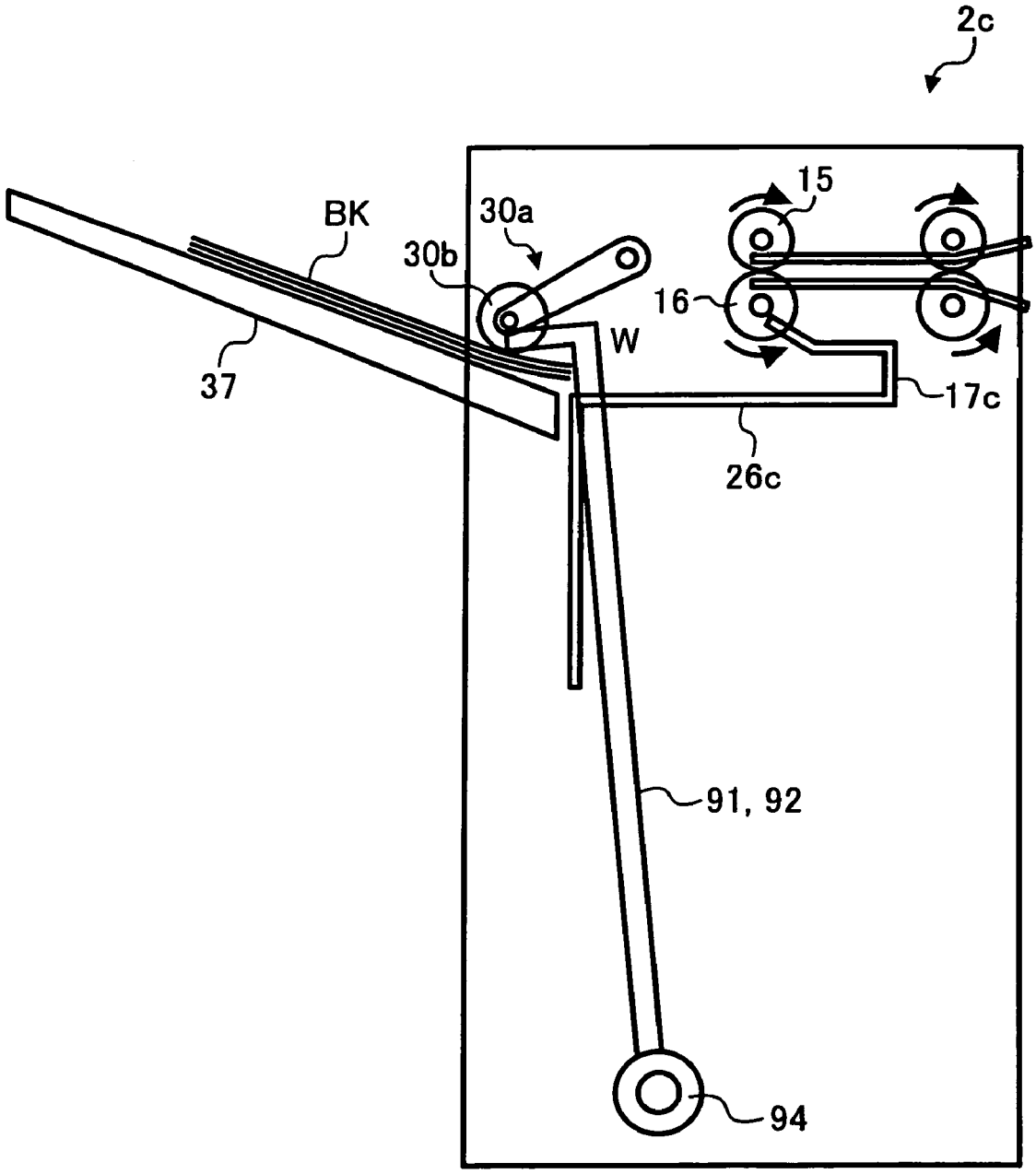
FIG. 30 is a sectional view of the sheet processing apparatus shown in FIG. 27 completing the pushing of the sheets.

As illustrated in FIG. 27, while the backing roller 30*b* is off the loading table 37, the upper roller 15 and the lower roller 16 feed a sheet P onto the loading table 37. As illustrated in FIG. 28, the swinging lever 30*d* swings counterclockwise to cause the backing roller 30*b* to contact the sheet P. The backing roller 30*b* feeds back the sheet P toward the head aligning board 17*c*. A head edge of the sheet P contacts the head aligning board 17*c*, which is vertical to the sheet conveyance direction and is aligned by the head aligning board 17*c*. The above operations are repeated until all sheets P to form a booklet BK are aligned. A stapler (not shown) staples the sheets P on their edge portion. As illustrated in FIG. 29, the link 91 moves to push the booklet BK toward the loading table 37 until the link 91 reaches a position W as illustrated in FIG. 30. When the booklet BK is completely delivered onto the loading table 37, the link 91 moves under the bottom aligning board 26*c* so that the extension 92 returns to the position U as illustrated in FIG. 27.

The link 91 supports the extension 92 in a manner that an elastic force causing the extension 92 to retract into the link 91 is applied to the extension 92. The pin 93 protruding from the extension 92 moves along the rail 90. Thus, when the link 91 is driven, the top end of the extension 92 moves on routes similar to routes of the pin 93 moving along the rail 90. Thus, the link 91 including the extension 92 moves as described above.

According to this non-limiting embodiment, the sheet processing apparatus 2*c* can perform operations similar to those of the sheet processing apparatus 2*a* more easily than the sheet processing apparatus 2 having the cam mechanism.

According to this non-limiting embodiment, structures and functions of the other parts not described above are similar to those of the sheet processing apparatus 2 according to the preceding embodiment.

The present invention has been described above with reference to specific embodiments. The present invention is not, however, limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

The invention claimed is:

1. A sheet processing apparatus, comprising:

a receiver configured to receive sheets;

an aligner configured to align the sheets;

a stapler configured to staple the aligned sheets;

a loading table configured to load the stapled sheets; and a pusher configured to push the stapled sheets from the stapler toward the loading table, wherein the pusher moves (1) from a first position at which the pusher presses against sheets on the loading table to help align the sheets on the loading table, (2)to a second position below the sheets on the loading table, by action of a forward-backward arm, and (3) from the second position to a third position by action of an upward-downward arm, (4) from the third position to a fourth position by action of the forward-backward arm, and (5) back to the first position by action of the upward-downward arm, the moving of the pusher from the third position to the fourth position including pushing the stapled sheets toward the loading table.

2. The sheet processing apparatus according to claim 1, wherein a top end of the pusher moves on different routes while the pusher moves from the first position to the second position and returns to the first position.

3. The sheet processing apparatus according to claim 2, wherein the top end of the pusher includes a hook configured to press the sheets placed on the loading table.

4. The sheet processing apparatus according to claim 3, wherein the hook is positioned at a stapling position on the sheets.

5. The sheet processing apparatus according to claim 2, wherein a speed at which the pusher moves on a route to push the stapled sheets toward the loading table is slower than a speed at which the pusher moves on other routes.

6. The sheet processing apparatus according to claim 1, further comprising:

a board configured to position the pusher;

a guide configured to guide the board; and a adjusting mechanism configured to lower the loading table until an uppermost surface of the sheets placed on the loading table is below the guide before the pusher starts moving.

7. The sheet processing apparatus according to claim 6, wherein the adjusting mechanism is further configured to adjust a height of the loading table after pusher delivers the stapled sheets onto the loading table.

8. The sheet processing apparatus according to claim 1, further comprising:

a control mechanism configured to control the receiver so that the receiver receives each of the sheets at a speed similar to a speed at which each of the sheets is conveyed inside an image forming apparatus connected with the sheet processing apparatus, and that the receiver feeds a tail end of each of the sheets in a sheet conveyance direction at a reduced speed.

9. The sheet processing apparatus according to claim 8, wherein the receiver includes a first roller and a second roller configured to feed each of the sheets, and the second roller has a diameter smaller than a diameter of the first roller.

10. The sheet processing apparatus according to claim 9, further comprising:

an entrance table configured to guide the sheets toward the first and second rollers, wherein a rotating axis of the second roller is positioned closer to the entrance table than a rotating axis of the first roller.

11. The sheet processing apparatus according to claim 1, wherein the aligner includes a first aligner and a second aligner configured to align the sheets parallel to a sheet conveyance direction and drivers configured to independently drive the first and second aligners.

12. The sheet processing apparatus according to claim 11, wherein the aligner further includes a third aligner configured to align the sheet perpendicularly to the sheet conveyance direction and a driver configured to drive the third aligner.

13. The sheet processing apparatus according to claim 1, wherein the loading table includes an absorber configured to absorb a bulge of a stapling position on the stapled sheets placed on the loading table.

14. An image forming apparatus, comprising:

an image forming mechanism configured to form an image on a sheet; and a sheet processing mechanism configured to process sheets and comprising:

a receiver configured to receive sheets;

an aligner configured to align the sheets;

a stapler configured to staple the aligned sheets;

a loading table configured to load the stapled sheets; and a pusher configured to push the stapled sheets from the stapler toward the loading table wherein the pusher moves (1) from a first position at which the pusher presses against sheets on the loading table to help align the sheets on the loading table, (2) to a second position below the sheets on the loading table, by action of a forward-backward arm, and (3) from the second position to a third position by action on an upward-downward arm, (4) from the third position to a fourth position by action of the forward-backward arm and (5)from the fourth position back to the first position by action of the upward-downward arm, the moving of the pusher from the third position to the fourth position including pushing the stapled sheets toward the loading table.

15. The image forming apparatus according to claim 14, wherein the image forming mechanism is integrated with the sheet processing mechanism.

16. A sheet processing apparatus, comprising:

means for receiving sheets;

means for aligning the sheets;

means for stapling the aligned sheets;

means for loading the stapled sheets; and means for pushing the stapled sheets from the means for stapling toward the means for loading wherein the means for pushing moves (1) from a first position at which the means for pushing presses against sheets on the means for loading to help align the sheets on the means for loading, (2) to a second position below the sheets on the means for loading, by action of a forward-backward arm, and (3) from the second position to a third position by action of an upward-downward arm, (4) from the third position to a fourth position by action of the forward-backward arm, and (5) from the fourth position back to the first position by action of the upward-downward arm, the moving of the means for pushing from the third position to the fourth position including pushing the stapled sheets toward the means for loading.

17. A method for sheet processing, comprising:

receiving sheets;

aligning the sheets;

stapling the aligned sheets with a stapler;

pushing with a pusher the stapled sheets from the stapler toward a loading table, wherein the pusher moves (1) from a first position at which the pusher presses against sheets on the loading table to help align the sheets on the loading table, (2) to a second position below the sheets on the loading table and stoppers at the second position until a stapling is completed, by action of a forward-backward arm, and (3) from the second position to a third position by action of an upward-downward arm, (4) from the third position to a fourth position by action of the forward-backward arm, and (5) from the fourth position back to the first position by action of the upward-downward arm, the moving of the pusher from the third position to the fourth position including pushing the stapled sheets toward the loading table; and loading the stapled sheets onto the loading table.

* * * * *